US010471709B2

(12) United States Patent
Nakahara

(10) Patent No.: US 10,471,709 B2
(45) Date of Patent: Nov. 12, 2019

(54) PRINTING DEVICE, PRINTING METHOD, AND STORAGE MEDIUM

(71) Applicant: CASIO COMPUTER CO., LTD., Shibuya-ku, Tokyo (JP)

(72) Inventor: Shota Nakahara, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/119,874

(22) Filed: Aug. 31, 2018

(65) Prior Publication Data

US 2019/0091996 A1 Mar. 28, 2019

(30) Foreign Application Priority Data

Sep. 27, 2017 (JP) ..... 2017-185753

(51) Int. Cl.

| | |
|---|---|
| ***B41J 3/36*** | (2006.01) |
| ***B41J 2/045*** | (2006.01) |
| ***B41J 25/00*** | (2006.01) |
| ***B41J 3/44*** | (2006.01) |

(52) U.S. Cl.

CPC ..... *B41J 2/04505* (2013.01); *B41J 2/04586* (2013.01); *B41J 3/36* (2013.01); *B41J 3/44* (2013.01); *B41J 25/001* (2013.01)

(58) Field of Classification Search

CPC ... B41J 2/04505; B41J 3/36; B41J 3/44; B41J 25/001; B41J 2/04586

See application file for complete search history.

(56) References Cited

U.S. PATENT DOCUMENTS

2017/0197444 A1* 7/2017 Hosokawa ..... B41J 2/125

FOREIGN PATENT DOCUMENTS

JP 2013014114 A 1/2013

* cited by examiner

*Primary Examiner* — Sharon A. Polk
(74) *Attorney, Agent, or Firm* — Holtz, Holtz & Volek PC

(57) ABSTRACT

A printing device includes a printing head configured to print an image on a printing medium while moving relative to the printing medium; a detector configured to detect a relative moving amount of the printing head with respect to the printing medium for each sampling cycle; and a processor configured to perform a first control to cause the printing head to perform printing when a moving speed of the printing head based on the moving amount detected by the detector and the sampling cycle is equal to or higher than a first moving speed at which the moving amount for each the sampling cycle becomes a reference distance corresponding to a print resolution of the printing head, the printing being performed at a timing that is set in accordance with the moving speed.

9 Claims, 14 Drawing Sheets

PRINTING DEVICE, PRINTING METHOD, AND STORAGE MEDIUM

BACKGROUND

1. Technical Field

The present invention relates to a printing device, a printing method, and a storage medium.

2. Related Art

There is known a printing device that prints an image to be printed on a printing medium, in accordance with a movement of its own device on the printing medium.

For example, JP 2013-14114A discloses a handy printer that prints an image to be printed by detecting a moving amount of a print head provided to the own device while moving on a printing medium, and printing pixels of a main scanning line by using the print head each time the detected moving amount of the print head increases by a pitch of the main scanning line.

SUMMARY

The present invention has an advantage that it is possible to provide a printing device, a printing method, and a storage medium that suppress deterioration in print quality.

In order to achieve the above advantage, a printing device according to the present invention includes:

a printing head configured to print an image on a printing medium while moving relative to the printing medium;

a detector configured to detect a relative moving amount of the printing head with respect to the printing medium for each sampling cycle; and a processor configured to perform a first control to cause the printing head to perform printing, when a moving speed of the printing head based on the moving amount detected by the detector and the sampling cycle is equal to or higher than a first moving speed at which the moving amount for each the sampling cycle becomes a reference distance corresponding to a print resolution of the printing head, the printing being performed at a timing that has been set in accordance with the moving speed.

BRIEF DESCRIPTION OF THE DRAWINGS

FIGS. 9A and 9B both are graphs for explaining printing by a printing device according to an embodiment of the present invention in a case where a control mode is set to a low-speed mode, wherein FIG. 9A is a graph showing a transition of a moving amount of the printing device detected by a detector, and FIG. 9B is a graph showing a transition of an accumulated value of the moving amount of the printing device;

FIGS. 10A and 10B both are graphs for explaining printing by a printing device according to an embodiment of the present invention in a case where a control mode is set to a high-speed mode, wherein FIG. 10A is a graph showing a transition of a moving amount of the printing device detected by a detector, and FIG. 10B is a graph showing a transition of a printing cycle;

FIGS. 11A and 11B both are graphs for explaining printing by a printing device according to an embodiment of the present invention in cases where a control mode is set to a low-speed mode and where the control mode is set to a high-speed mode, wherein FIG. 11A is a graph showing a transition of a moving speed of the printing device, and FIG. 11B is a graph showing a transition of a moving distance of the printing device;

DETAILED DESCRIPTION

Figure 1:
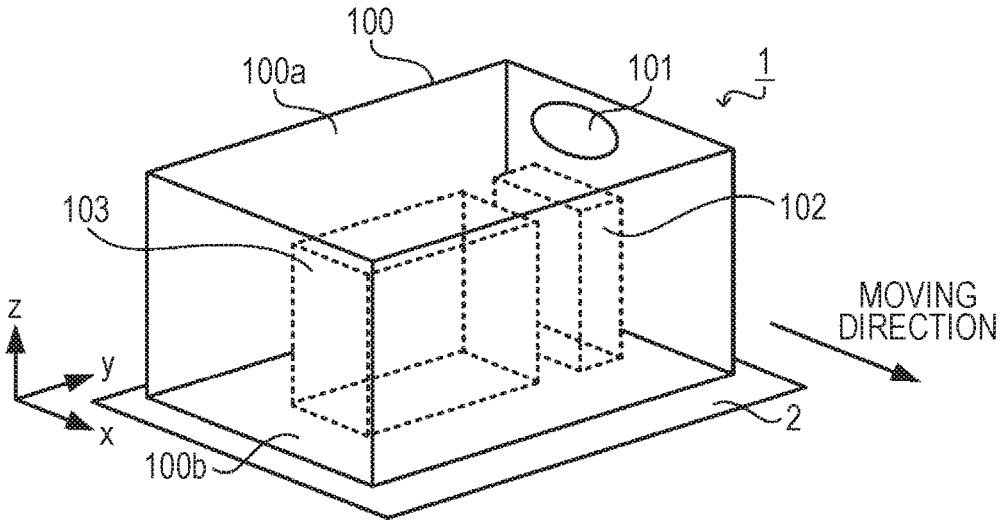
FIG. 1 is a view showing an appearance of a printing device according to an embodiment of the present invention.

Hereinafter, a printing device according to an embodiment of the present invention will be described with reference to the drawings. In the drawings, mutually same or equivalent configurations are denoted by mutually same reference numerals.

A printing device 1 shown in FIG. 1 is a manual-scanning printing device that can be grasped by a user and moved on a printing medium 2, and the printing device 1 prints an image to be printed on the printing medium 2 in accordance with the movement. A manual-scanning printing device is also called a handy printer, a handheld printer, or the like. It is to be noted that a printing device 1 merely has to move relative to the printing medium 2 during printing, and may be in a form such that, for example, the printing device 1 is fixed while the printing medium 2 is moved relative to the printing device 1.

The image to be printed is an image that is to be printed on the printing medium 2 by the printing device 1. The image to be printed is also called a print image, a print pattern, or the like. Specific examples of images to be printed include letters, figures, symbols, patterns, pictures, combinations of these, and the like.

The printing medium 2 is an object that is to be printed with an image to be printed during printing. The printing medium 2 is also called a printed medium, a storage medium, a print object, or the like. Specific examples of the printing medium 2 include paper, cloth, a synthetic resin, a corrugated cardboard, a box, a bottle, and the like. The printing device 1, which is a manual-scanning printing device, can perform printing on a wider variety of printing medium 2 than a stationary printing device that performs printing while conveying the printing medium 2. In other words, in addition to being able to perform printing on a printing medium 2 such as paper that can be easily conveyed in a same manner as a stationary printing device, the printing device 1 can also print on a printing medium 2 such as cloth, a synthetic resin, a corrugated cardboard, a box, and a bottle that have a material and a shape difficult to convey, and are difficult to print with the stationary printing device.

A direction in which a user moves the printing device 1 during printing is referred to as a moving direction. The moving direction is also referred to as a sub-scanning direction, a printing direction, or the like. To facilitate understanding, there are provided xyz coordinate axes shown in FIG. 1. Hereinafter, the x-axis positive direction is referred to as a right direction. Hereinafter, a case where a user moves the printing device 1 in the right direction as the moving direction will be described as an example.

The printing device 1 is provided with a low-speed mode and a high-speed mode as control modes. While details will be described later, the printing device 1 sets the control mode of the own device to either the low-speed mode or the high-speed mode in accordance with a moving speed of the own device. Further, while details will be described later, the printing device 1 performs printing with mutually different printing methods for cases where the control mode is set to the low-speed mode and where the control mode is set to the high-speed mode.

The printing device 1 includes a device body 100, a start button 101, a detector 102, and a printing mechanism 103. Although the detector 102 and the printing mechanism 103 are incorporated in the device body 100 and actually not visually recognizable from outside, the detector 102 and the printing mechanism 103 are illustrated by broken lines to facilitate understanding in FIG. 1.

The device body 100 is also called a housing or the like and is held by a user. The device body 100 has an upper surface 100*a* and a bottom surface 100*b*. The bottom surface 100*b* is a surface facing the printing medium 2 during printing. The upper surface 100*a* is a surface opposite to the bottom surface 100*b*.

The start button 101 accepts an instruction to start printing by the user. When the start button 101 is pressed, a print start condition to be described later is satisfied. The start button 101 is disposed on the upper surface 100*a* of the device body 100, for example.

The detector 102 detects a relative moving amount of the printing device 1, with respect to the printing medium 2. The detector 102 supplies the detected data representing the moving amount of the printing device 1 to a control circuit 104 to be described later. Specifically, the detector 102 includes an optical sensor (not shown), and outputs a detection signal to the control circuit 104 for each preset sampling cycle. The detection signal includes a moving amount detection signal indicating a moving direction and a moving amount per sampling cycle of the printing device 1 on the printing medium 2. The sampling cycle is set in advance by any method such as experiment in accordance with a performance and the like of the optical sensor. The sampling cycle corresponds to Nts-(N−1)ts (N is an integer of 1 or more) in FIGS. 9A, 9B, 10A, and 10B, and is 500 μsec, for example. More specifically, the detector 102 includes a laser optical sensor having an image sensor and a light source that irradiates a surface of the printing medium 2 with a laser beam, and the image sensor captures the laser beam irradiated on the surface of the printing medium 2 from the light source and reflected on the surface of the printing medium 2. The detector 102 generates a detection signal including a moving amount detection signal by analyzing an interference fringe of the captured laser light, and outputs the generated detection signal to the control circuit 104.

Based on the moving amount detection signal included in the detection signal output by the detector 102, the printing device 1 acquires a moving amount and a moving speed of the printing device 1, which is the own device. Further, the printing device 1 determines whether or not the own device has been lifted off, by determining whether or not the detection signal output by the detector 102 satisfies a preset lift-off condition. Lift off means that the printing device 1 is lifted up during printing and is separated from the printing medium 2 by a preset lift-off distance or more. The lift-off condition and the lift-off distance are preset by any method such as experiment. Since it is not desirable that the printing device 1 continues printing and continues to eject ink in the lift-off state, the printing device 1 stops printing when lifted off as will be described later.

Figure 2:
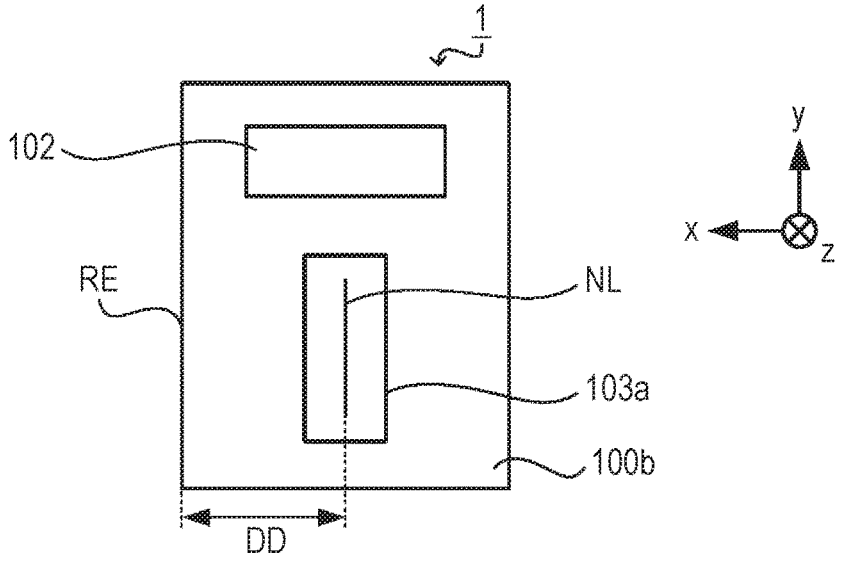
FIG. 2 is a bottom view of a printing device according to an embodiment of the present invention.

As shown in FIG. 2, the detector 102 is provided to be exposed outside through an opening provided on the bottom surface 100*b* of the device body 100.

Returning to FIG. 1, the printing mechanism 103 prints an image to be printed on the printing medium 2 by an inkjet method of ejecting droplets of ink onto the printing medium 2.

Specifically, as shown in FIG. 2, the printing mechanism 103 includes an ink jet head 103*a*. The ink jet head 103*a* is provided to be exposed outside through an opening provided on the bottom surface 100*b* of the device body 100. The ink jet head 103*a* is also called a printing head, a recording head, a print head, or the like. In accordance with control by an ink jet head control circuit 103*b*, which will be described later, the ink jet head 103*a* performs printing by ejecting ink filled in an ink tank (not shown), onto the printing medium 2. The ink jet head 103*a* and the above-described ink tank may be collectively referred to as an ink cartridge or the like. The ink jet head 103*a* functions as a printing head. Further, the above-described detector 102 detects a relative moving amount of the ink jet head 103*a* with respect to the printing medium 2 for each sampling cycle.

More specifically, the ink jet head 103*a* has a nozzle row NL. The nozzle row NL is provided in parallel with the y-axis direction that is perpendicular to the x-axis and is parallel to a surface direction of the printing medium 2. The nozzle row NL is arranged to be apart from a right end RE of the bottom surface 100*b* of the device body 100 by a distance DD to the left. As will be described later, when performing printing using the printing device 1, the user moves the printing device 1 while visually checking the right end RE of the bottom surface 100*b*, and sets a desired position as a printing start position.

The nozzle row NL each includes a plurality of ink nozzles (not shown). When ink inside the ink nozzle is heated by a heater, bubbles are generated, and a burst of this bubble causes the ink to be ejected from the ink nozzle to the printing medium 2.

While details will be described later, when the control mode of the printing device 1 is set to the low-speed mode, the printing mechanism 103 prints an image to be printed by ejecting ink onto the printing medium 2 each time the detector 102 detects that the printing device 1 has moved by a preset reference distance. The reference distance is set in advance by any method such as experiment in accordance with a printing resolution and the like of printing performed by the printing device 1. Specifically, in the present embodiment, the reference distance is set to a dot pitch corresponding to a print resolution of printing performed by the ink jet head 103*a* of the printing device 1. For example, when the printing resolution is 600 dpi, the reference distance is set to 42.3 μm. While details will be described later, when the control mode of the printing device 1 is set to the high-speed mode, the printing mechanism 103 prints an image to be printed by ejecting ink onto the printing medium 2 for each printing cycle corresponding to the moving speed of the printing device 1.

The printing mechanism 103 starts printing in response to the fact that the printing device 1 has moved by a preset approach distance after a preset print start condition is satisfied. In the present embodiment, the print start condition is satisfied when the start button 101 is pressed. Further, in the present embodiment, the distance DD between the right end RE of the bottom surface 100*b* of the device body 100 and the nozzle row NL is set as the approach distance.

The printing mechanism 103 starts printing in response to the fact that the printing device 1 has moved by the distance DD between the right end RE of the bottom surface 100*b* of the device body 100 and the nozzle row NL, which is the approach distance after the start button 101 is pressed. Therefore when printing is performed using the printing device 1, the user can move the printing device 1 while visually checking the right end RE of the bottom surface 100*b* and set a desired position as a print start position. Hereinafter, a description is given to a function of the right end RE of the bottom surface 100*b* in setting a desired position as the printing start position in printing using the printing device 1, with reference to FIGS. 3 to 5. Specifically, a case will be described where the user desires to set, as the printing start position, a position on the printing medium 2 with the x coordinate of X1, as an example.

Figure 3:
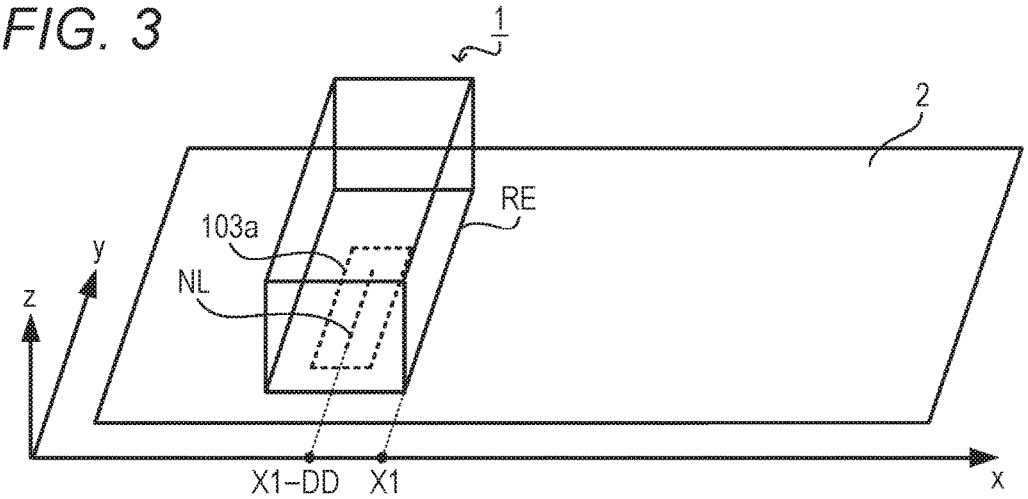
FIG. 3 is a first view for explaining setting of a print start position in printing using a printing device according to an embodiment of the present invention.
Figure 4:
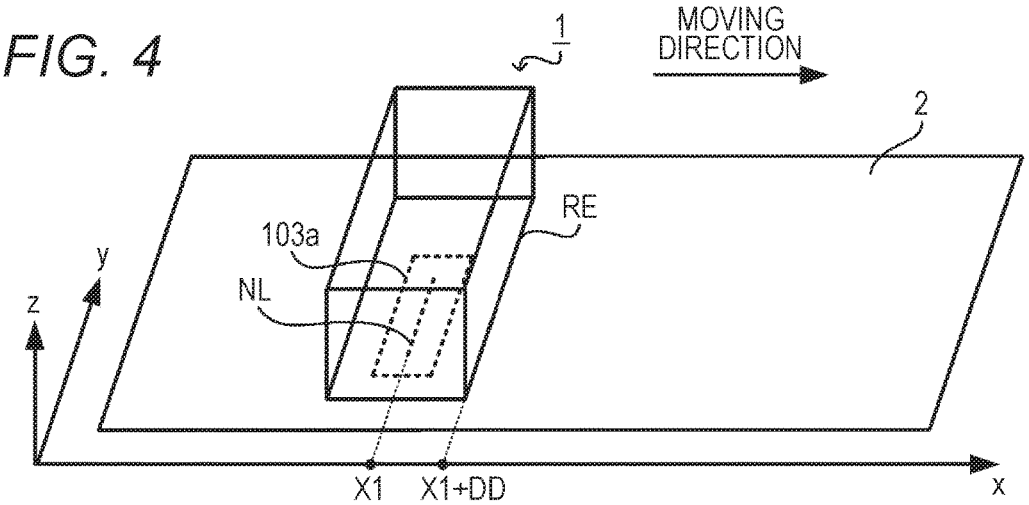
FIG. 4 is a second view for explaining setting of a print start position in printing using a printing device according to an embodiment of the present invention.
Figure 5:
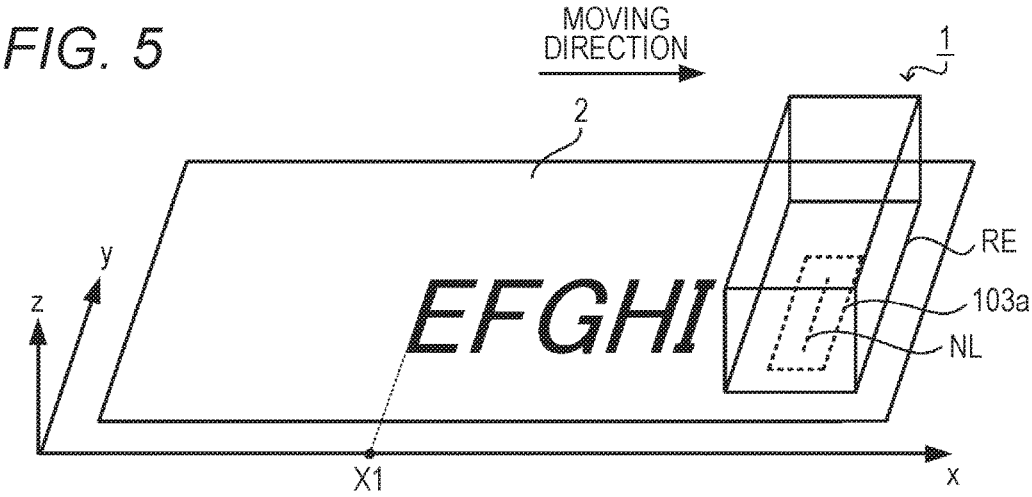
FIG. 5 is a third view for explaining setting of a print start position in printing using a printing device according to an embodiment of the present invention.

During printing, the user moves the printing device 1 while visually checking the right end RE of the bottom surface 100*b* of the device body 100 in a state where the printing device 1 is placed on the printing medium 2, and places the printing device 1 such that the x coordinate of the right end RE coincides with X1, as shown in FIG. 3. In this state, the nozzle row NL included in the ink jet head 103*a* is disposed at a position with the x coordinate of X1-DD. In this state, printing is started when the user presses the start button 101 to instruct a print start, and moves the printing device 1 in the moving direction by the distance DD set as the approach distance between the right end RE and the nozzle row NL as shown in FIG. 4. At a time point when printing is started, the nozzle row NL to perform printing is disposed at a position with the x coordinate of X1. Thereafter, when the user continues to move the printing device 1 in the moving direction, text "EFGHI" as an image to be printed is printed with the x coordinate of X1 as the printing start position, as shown in FIG. 5.

Hereinafter, an operation in which the printing device 1 is moved by the approach distance after the print start condition is satisfied is referred to as approach. That is, the printing device 1 starts printing in response to completion of approach.

Figure 6:
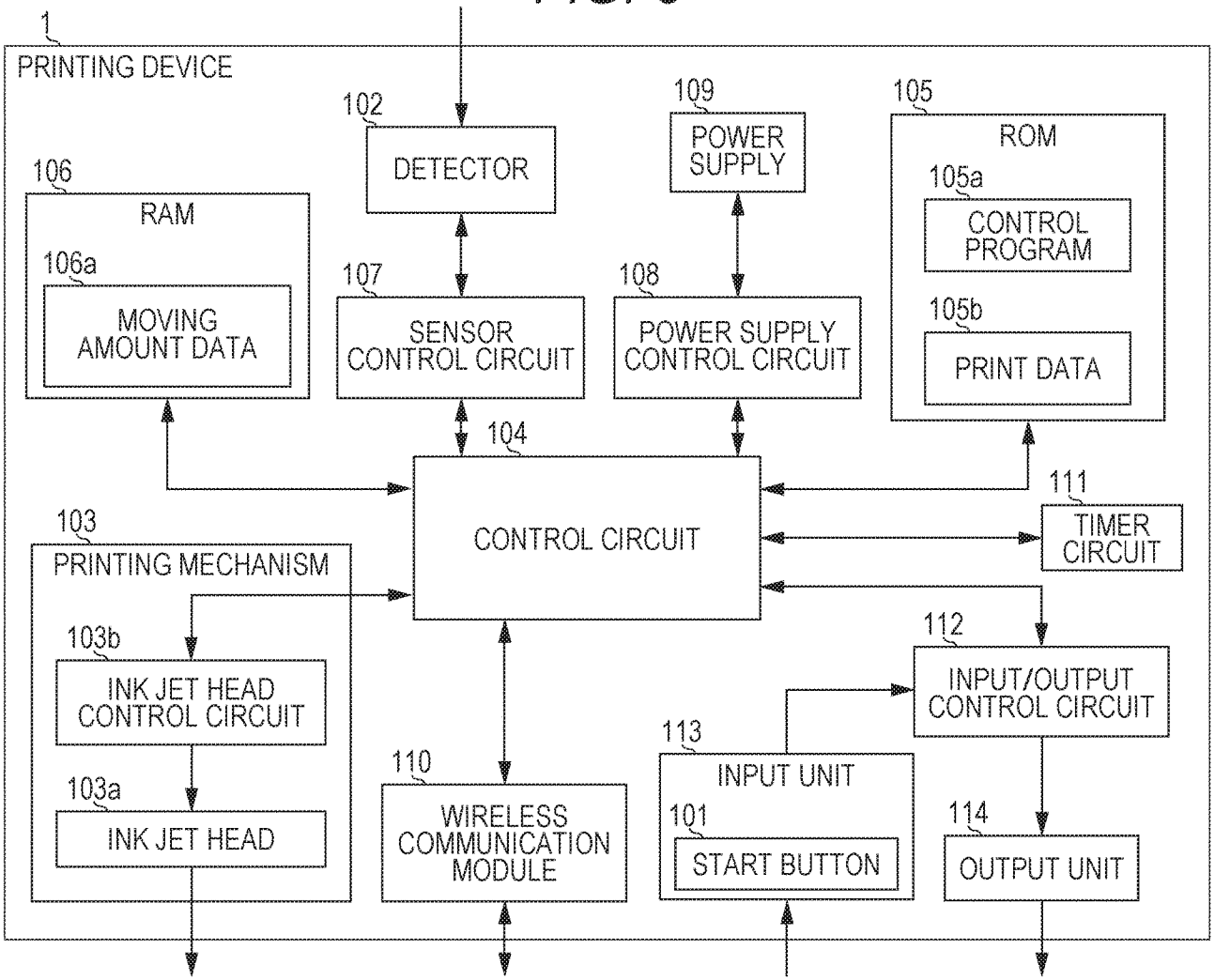
FIG. 6 is a diagram showing an electrical configuration of a printing device according to an embodiment of the present invention.

In addition to each of the above-described configurations, the printing device 1 includes, as shown in FIG. 6, the control circuit 104, a read only memory (ROM) 105, a random access memory (RAM) 106, a sensor control circuit 107, a power supply control circuit 108, a power supply 109, the ink jet head control circuit 103*b*, a wireless communication module 110, a timer circuit 111, an input/output control circuit 112, an input unit 113, and an output unit 114.

The control circuit 104 includes a central processing unit (CPU) as a processor, and executes various processes including a print process to be described later, in accordance with a program and data stored in the ROM 105. The control circuit 104 is connected to each part of the printing device 1 via a system bus (not shown) that is a transmission path for command and data, and integrally controls the entire printing device 1.

The ROM 105 stores a program and data to be used for executing various processes by the control circuit 104. Specifically, the ROM 105 stores a control program 105*a* to be executed by the control circuit 104. Further, the ROM 105 stores print data 105*b* representing an image to be printed. The printing device 1 acquires the print data 105*b* generated by an external device such as a personal computer (PC) or a smart phone, from the external device via the wireless communication module 110, and stores the data in the ROM 105.

The RAM 106 stores data generated or acquired by the control circuit 104 executing various processes. Specifically, the RAM 106 stores moving amount data 106*a* representing a moving direction of the printing device 1 and a moving amount per sampling cycle that are indicated by the moving amount detection signal output by the detector 102. Further, the RAM 106 functions as a work area of the control circuit 104. That is, the control circuit 104 executes various processes by reading out the program and data stored in the ROM 105 to the RAM 106, and appropriately referring to the read out program and data.

The sensor control circuit 107 controls the detector 102 in accordance with control by the control circuit 104. The power supply control circuit 108 controls the power supply 109 in accordance with control by the control circuit 104. The power supply 109 includes a battery and supplies power to each part of the printing device 1 in accordance with control by the power supply control circuit 108.

The ink jet head control circuit 103*b* is provided in the printing mechanism 103, and controls ejection of ink by the ink jet head 103*a* in accordance with control by the control circuit 104. Specifically, the ink jet head control circuit 103*b* sequentially transmits the print data 105*b* to the ink jet head 103*a* for each line in accordance with control by the control circuit 104. The print data 105*b* for one line represents an image to be printed for one unit, which is an image of a portion that can be printed without movement of the printing device 1, in the image to be printed. In accordance with control by the control circuit 104, the printing mechanism 103 sequentially prints the image to be printed for each unit. While details will be described later, when the control mode of the printing device 1 is set to the low-speed mode, in accordance with control by the control circuit 104, the ink jet head control circuit 103*b* sequentially transmits the print data 105*b* for one line to the ink jet head 103*a* each time the detector 102 detects that the printing device 1 has moved by the reference distance. Further, when the control mode of the printing device 1 is set to the high-speed mode, in accordance with control by the control circuit 104, the ink jet head control circuit 103*b* sequentially transmits the print data 105*b* for one line to the ink jet head 103*a* for each printing cycle corresponding to a moving speed of the printing device 1. When the ink jet head control circuit 103*b* transmits the print data 105*b* for one line to the ink jet head 103*a*, the ink jet head control circuit 103*b* causes the ink jet head 103*a* to eject ink from a specific ink nozzle specified by the print data 105*b* among a plurality of ink nozzles included in the nozzle row NL, by transmitting an ejection command instructing ink ejection to the ink jet head 103*a*, to perform printing. This causes printing of an image to be printed for one unit represented by the print data 105*b* for one line.

The wireless communication module 110 transmits and receives data with an external device such as a PC or a smart phone, by performing wireless communication via a communication network such as a wireless local area network (LAN). Specifically, the printing device 1 acquires the print data 105*b* generated by the external device, from the external device via the wireless communication module 110. The timer circuit 111 includes a real time clock (RTC) circuit that continues to generate a clock signal of a constant cycle even while power supply by the power supply 109 is stopped, and always counts time based on the clock signal. The timer circuit 111 supplies data representing a time counting result to the control circuit 104. The input/output control circuit 112 controls the input unit 113 and the output unit 114 in accordance with control by the control circuit 104.

The input unit 113 includes an input device such as various operation buttons including the start button 101, an input key, a switch, a touch pad, or a touch panel. Further, the input unit 113 accepts various operation instructions input by the user, and supplies the accepted operation instruction to the control circuit 104. Specifically, the input unit 113 includes the start button 101 and a sensor to detect depression of the start button 101, and the input unit 113 accepts an operation instruction to start printing in response to the depression of the start button 101. The output unit 114 includes an output device such as a speaker, a display, or a light emitting device, and outputs various information in a form recognizable by the user.

Figure 7:
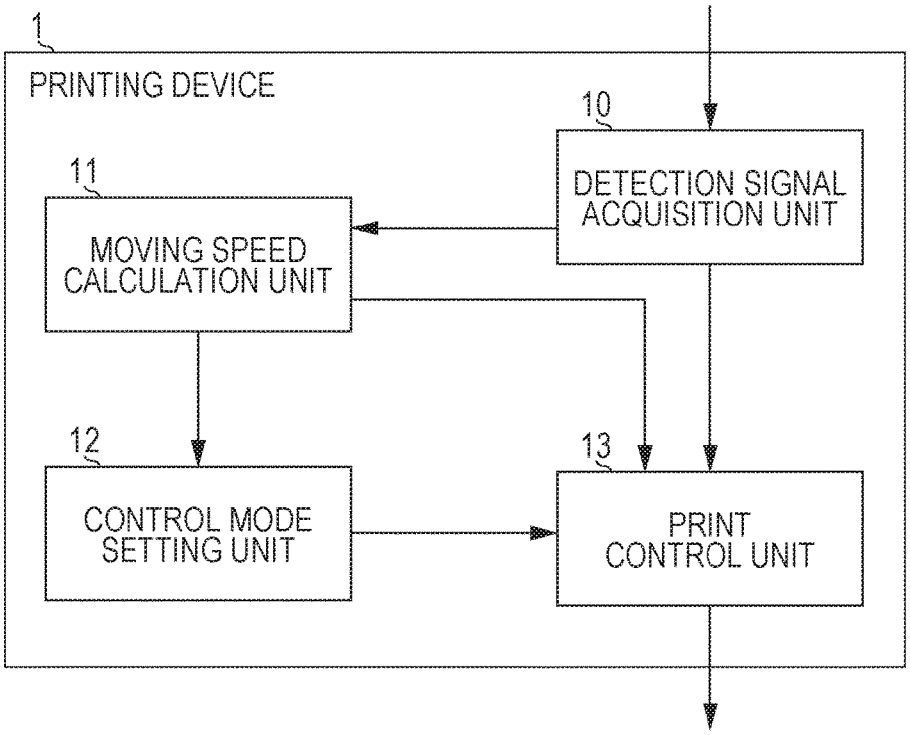
FIG. 7 is a diagram showing a functional configuration of a printing device according to an embodiment of the present invention.

As a function of the control circuit 104, the printing device 1 having the above-described physical configuration includes a detection signal acquisition unit 10, a moving speed calculation unit 11, a control mode setting unit 12, and a print control unit 13, as shown in FIG. 7. The control circuit 104 functions as each of these units by executing the control program 105*a* to control the printing device 1. The detection signal acquisition unit 10 acquires a detection signal including the above-described moving amount detection signal from the detector 102 for each sampling cycle of the optical sensor provided to the detector 102. The detection signal acquisition unit 10 supplies the acquired detection signal to the moving speed calculation unit 11 and the print control unit 13.

The moving speed calculation unit 11 calculates a moving speed of the printing device 1 in accordance with the moving amount detection signal included in the detection signal supplied from the detection signal acquisition unit 10. Specifically, the moving speed calculation unit 11 calculates the moving speed of the printing device 1 by dividing the moving amount, which is indicated by the moving amount detection signal, of the printing device 1 per sampling cycle of the optical sensor provided to the detector 102, by the sampling cycle. The moving speed calculation unit 11 supplies data indicating the calculated moving speed, to the control mode setting unit 12 and the print control unit 13.

The control mode setting unit 12 sets the control mode of the printing device 1 to either the low-speed mode or the high-speed mode in accordance with the moving speed of the printing device 1 calculated by the moving speed calculation unit 11. The control mode setting unit 12 supplies, to the print control unit 13, data indicating whether the control mode of the printing device 1 is set to the low-speed mode or to the high-speed mode. Specifically, while the printing device 1 is performing printing, the control mode setting unit 12 determines whether or not to switch the control mode of the printing device 1 between the low-speed mode and the high-speed mode, in accordance with the moving speed of the printing device 1 for each sampling cycle of the optical sensor provided to the detector 102.

Figure 8:
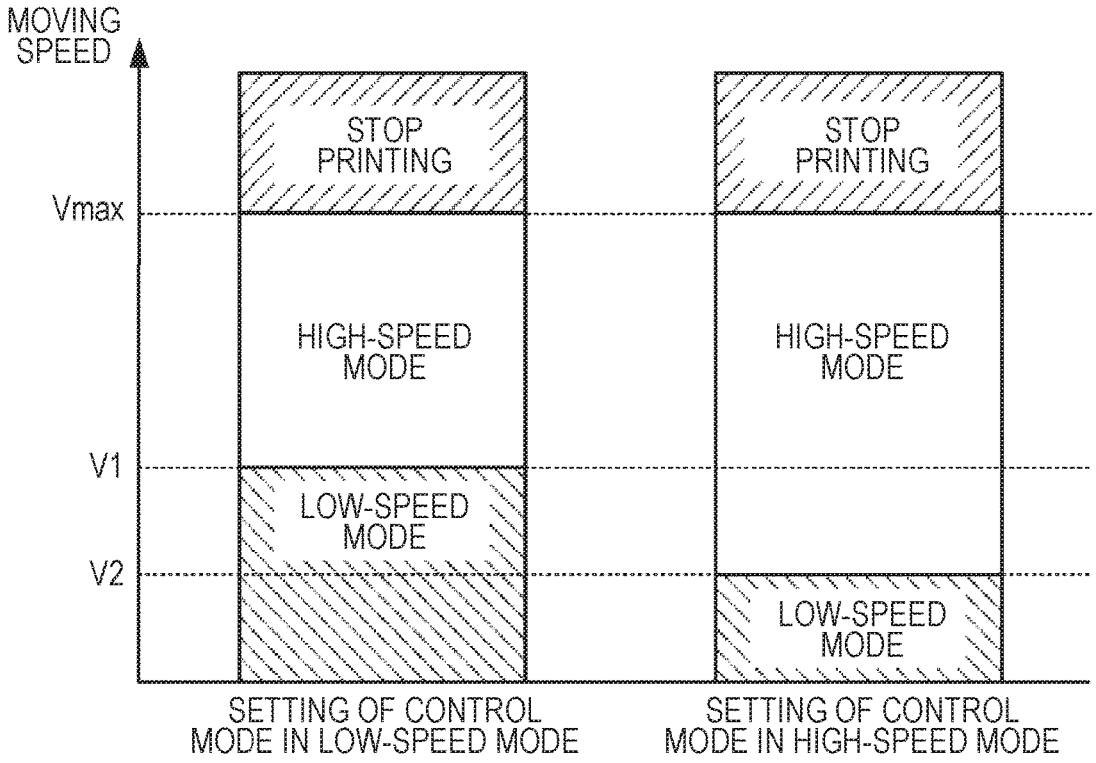
FIG. 8 is a view for explaining setting of a control mode by a printing device according to an embodiment of the present invention.

More specifically, as shown in FIG. 8, when it is determined that the moving speed of the printing device 1 is lower than a first speed V1 set in advance in a state where the control mode of the printing device 1 is set to the low-speed mode, the control mode setting unit 12 maintains the control mode in the low-speed mode. Whereas, when it is determined that the moving speed of the printing device 1 is lower than a maximum speed Vmax set in advance and is equal to or higher than the first speed V1 in a state where the control mode of the printing device 1 is set to the low-speed mode, the control mode setting unit 12 changes the control mode from the low-speed mode to the high-speed mode.

Further, when it is determined that the moving speed of the printing device 1 is equal to or higher than the a second speed V2 set in advance and lower than the maximum speed Vmax in a state where the control mode of the printing device 1 is set to the high-speed mode, the control mode setting unit 12 maintains the control mode in the high-speed mode. Whereas, when it is determined that the moving speed of the printing device 1 is lower than the second speed V2 in a state where the control mode of the printing device 1 is set to the high-speed mode, the control mode setting unit 12 changes the control mode from the high-speed mode to the low-speed mode. The second speed V2 is set to a speed lower than the first speed V1. That is, when the moving speed of the printing device 1 is equal to or higher than the first speed V1 and is lower than the maximum speed Vmax, the control mode setting unit 12 sets the control mode of the printing device 1 to the high-speed mode, and when the moving speed of the printing device 1 is lower than the second speed V2, the control mode setting unit 12 sets the control mode of the printing device 1 to the low-speed mode.

The maximum speed Vmax is set in advance by any method such as experiment, in accordance with a maximum value of a speed and the like at which the printing mechanism 103 can perform printing without lowering print quality. In the present embodiment, the maximum speed Vmax is set to 200 mm/sec. If printing is performed when the moving speed of the printing device 1 is equal to or higher than the maximum speed Vmax, an image to be printed may be stretched in the moving direction of the printing device 1 to cause distorted print, lowering print quality. Therefore, as will be described later, in either case where the control mode of the printing device 1 is set to the high-speed mode or the low-speed mode, when the moving speed of the printing device 1 is equal to or higher than the maximum speed Vmax, the print control unit 13 causes the printing mechanism 103 to stop printing, thereby suppressing deterioration in print quality.

The first speed V1 and the second speed V2 are set in advance by any method such as experiment. In the present embodiment, the first speed V1 is set to 90 mm/sec and the second speed V2 is set to 45 mm/sec.

In a case where the first speed V1, which is a threshold value at which the control mode of the printing device 1 is switched from the low-speed mode to the high-speed mode, is an equal speed to the second speed V2, which is a threshold value at which the control mode of the printing device 1 is switched from the high-speed mode to the low-speed mode, the control mode of the printing device 1 is switched each time a magnitude relation between this same speed and the moving speed of the printing device 1 changes. Whereas, in the present embodiment, the first speed V1 and the second speed V2 are mutually different. Therefore, in a state where the control mode of the printing device 1 is set to the low-speed mode, even when the moving speed of the printing device 1 falls below the first speed V1 after the control mode is changed from the low-speed mode to the high-speed mode based on the fact that the moving speed of the printing device 1 is equal to or higher than the first speed V1, the control mode will not be changed from the high-speed mode to the low-speed mode unless the moving speed falls below the second speed V2. Further, in a state where the control mode of the printing device 1 is set to the high-speed mode, even when the moving speed of the printing device 1 becomes equal to or higher than the second speed V2 after the control mode is changed from the high-speed mode to the low-speed mode based on the fact that the moving speed of the printing device 1 is lower than the second speed V2, the control mode will not be changed from the low-speed mode to the high-speed mode unless the moving speed becomes equal to or higher than the first speed V1. Therefore, in the present embodiment, a switching frequency of the control mode of the printing device 1 is suppressed as compared with a case where the first speed V1 and the second speed V2 are the mutually same speed.

As the switching frequency of the control mode of the printing device 1 increases, a processing load on the printing device 1 increases. Further, since the printing device 1 performs printing by a different printing method depending on the control mode, the printing method is switched very frequently when the switching frequency of the control mode becomes extremely large, which may cause deterioration in print quality. Therefore, by setting the first speed V1 and the second speed V2 to mutually different speeds, the printing device 1 suppresses a switching frequency of the control mode, reduces a processing load, and reduces a possibility of deterioration in print quality.

As described above, while the printing device 1 is performing printing, the control mode setting unit 12 sets the control mode of the printing device 1 in accordance with the moving speed of the printing device 1. Further, the control mode setting unit 12 sets the control mode of the printing device 1 at a start of printing in accordance with the moving speed of the printing device 1 during a period from after the above-described printing condition is satisfied until the printing device 1 moves by the approach distance, that is, in accordance with the moving speed of the printing device 1 during approach. In other words, the control mode setting unit 12 sets the control mode of the printing device 1 at a start of printing in accordance with the moving speed of the printing device 1 in a state where the print start condition is satisfied but the printing is not yet started.

Specifically, when the moving speed of the printing device 1 during the approach satisfies a first condition set in advance, the control mode setting unit 12 sets the control mode of the printing device 1 at a start of printing to the low-speed mode. In the present embodiment, the first condition is satisfied when an approach speed, which is an average value of the moving speed of the printing device 1 during approach, is lower than the first speed V1. When the moving speed of the printing device 1 during approach satisfies a second condition set in advance, the control mode setting unit 12 sets the control mode of the printing device 1 at a start of printing to the high-speed mode. In the present embodiment, the second condition is satisfied when the approach speed is equal to or higher than the first speed V1 and is lower than the maximum speed Vmax.

The print control unit 13 controls the printing mechanism 103 to print the image to be printed. Specifically, in response to the fact that the printing device 1 has moved by the approach distance after the above-described print start condition is satisfied, that is, in response to completion of the approach, the print control unit 13 causes the printing mechanism 103 to start printing. In other words, in accordance with control by the print control unit 13, the printing mechanism 103 starts printing in response to completion of approach.

The print control unit 13 causes the printing mechanism 103 to perform printing using mutually different printing methods for cases where the control mode of the printing device 1 is set to the low-speed mode and where the control mode of the printing device 1 is set to the high-speed mode. Specifically, when the control mode of the printing device 1 is set to the low-speed mode, the print control unit 13 causes the printing mechanism 103 to print an image to be printed by ejecting ink onto the printing medium 2 each time the detector 102 detects that the printing device 1 has moved by the reference distance described above. Hereinafter, a description is given to printing by the printing device 1 when the control mode of the printing device 1 is set to the low-speed mode, with reference to FIGS. 9A and 9B.

Figure 9A:
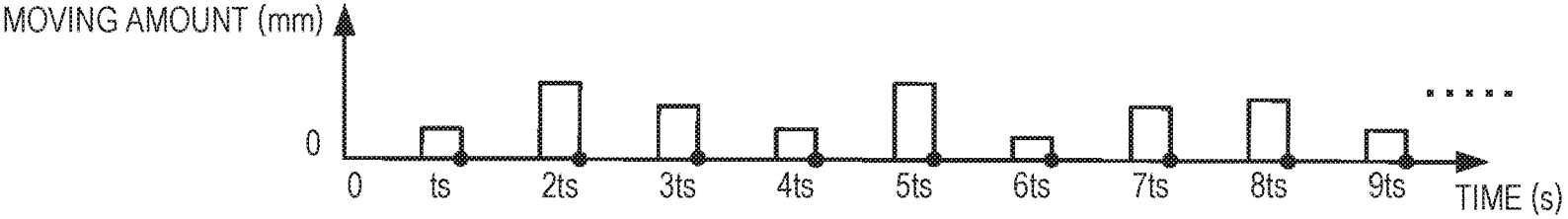
Figure 9B:
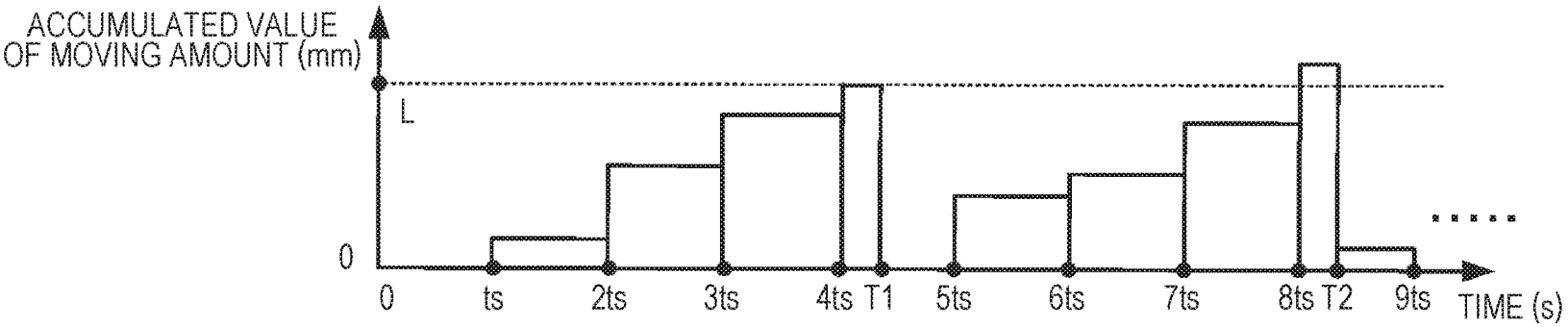

The detector 102 outputs a moving amount detection signal indicating the moving amount of the printing device 1 for each sampling cycle of the optical sensor provided to the detector 102. Hereinafter, a description is given to a case where the detector 102 outputs a moving amount detection signal at each timing of times ts to 9ts as an example, as shown in FIG. 9A. Each time the detector 102 outputs the moving amount detection signal, the print control unit 13 acquires the output moving amount detection signal via the detection signal acquisition unit 10, and by successively adding the moving amount per sampling cycle of the printing device 1 indicated by the acquired moving amount detection signal, the print control unit 13 updates an accumulated value of the moving amount of the printing device 1. Specifically, as shown in FIG. 9B, the print control unit 13 updates the accumulated value of the moving amount of the printing device 1 at each timing of the times ts to 9ts, which is a timing at which the moving amount detection signal is output by the detector 102. When the updated accumulated value of the moving amount of the printing device 1 becomes equal to or larger than a reference distance L, the print control unit 13 causes the printing mechanism 103 to eject ink to perform printing. Specifically, as shown in FIG. 9B, the print control unit 13 calculates times T1 and T2 when the accumulated value of the moving amount of the printing device 1 becomes the reference distance L, and causes the printing mechanism 103 to eject ink at each timing of the times T1 and T2 to perform printing. When the printing mechanism 103 ejects ink to perform printing, the print control unit 13 subtracts the reference distance L from the accumulated value of the moving amount of the printing device 1 as shown in FIG. 9B. By repeatedly performing the above-described operation, the printing device 1 causes the printing mechanism 103 to eject ink to perform printing each time the detector 102 detects that the printing device 1 has moved by the reference distance L.

When the control mode of the printing device 1 is set to the high-speed mode, the print control unit 13 causes the printing mechanism 103 to print an image to be printed by ejecting ink onto the printing medium 2 for each printing cycle corresponding to the moving speed of the printing device 1 calculated by the moving speed calculation unit 11. Hereinafter, a description is given to printing by the printing device 1 when the control mode of the printing device 1 is set to the high-speed mode, with reference to FIG. 10.

Figure 10A:
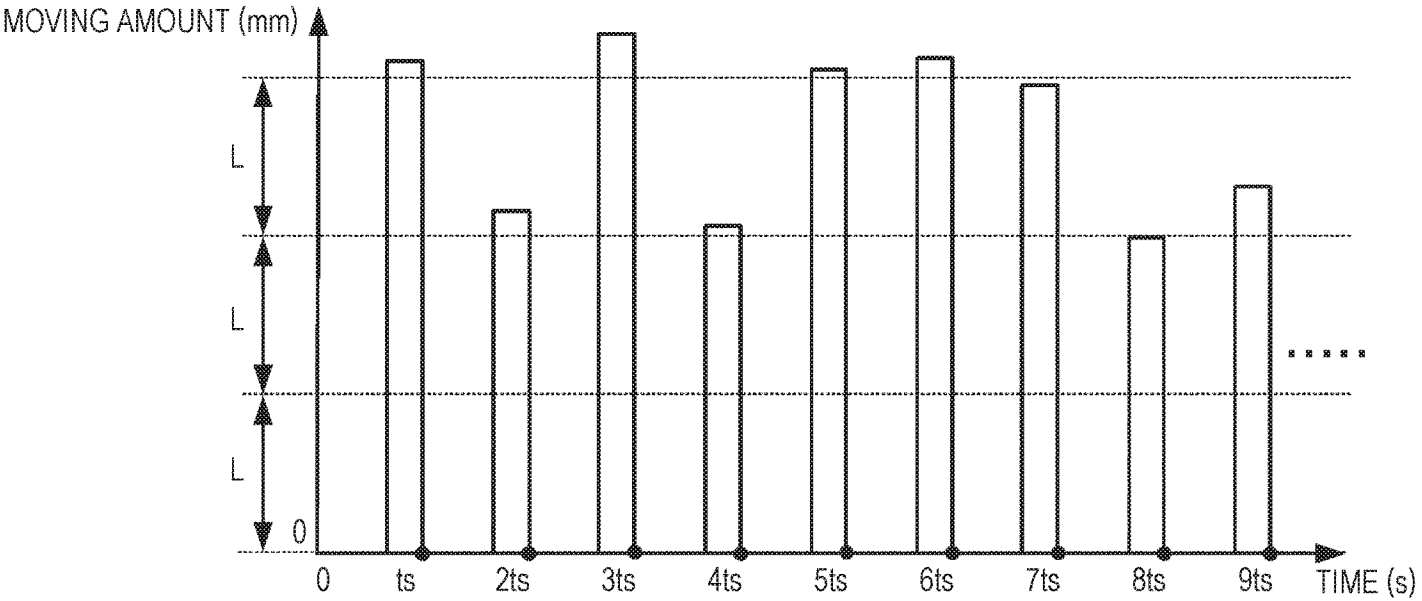
Figure 10B:
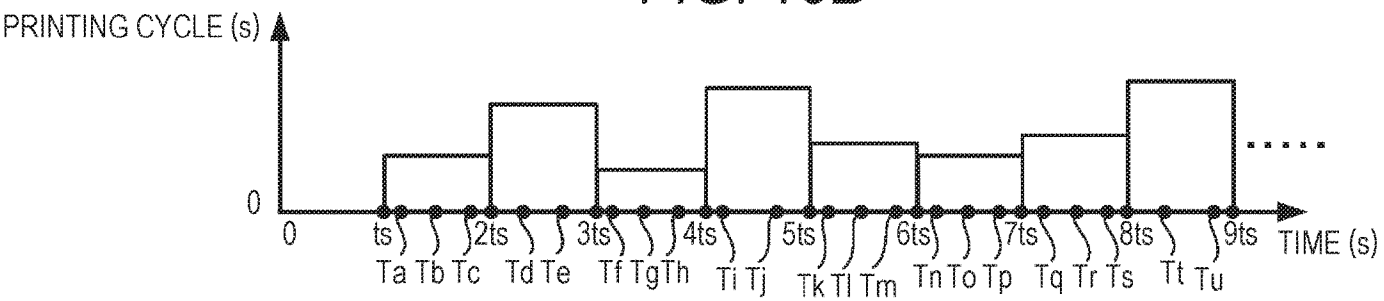

The detector 102 outputs a moving amount detection signal indicating the moving amount of the printing device 1 for each sampling cycle of the optical sensor provided to the detector 102. Hereinafter, a description is given to a case where the detector 102 outputs a moving amount detection signal at each timing of the times is to 9ts, as an example as shown in FIG. 10A. Each time the detector 102 outputs the moving amount detection signal, the moving speed calculation unit 11 acquires the output moving amount detection signal via the detection signal acquisition unit 10, and calculates the moving speed of the printing device 1 in accordance with the moving amount of the printing device 1 indicated by the acquired moving amount detection signal. Here, as shown in FIG. 10A, the moving distance at each timing is larger than the reference distance L. As shown in FIG. 10B, at each timing of the times ts to 9ts, which is a timing at which the moving amount detection signal is output by the detector 102, the print control unit 13 sets the printing cycle corresponding to the moving speed of the printing device 1 calculated by the moving speed calculation unit 11. More specifically, the print control unit 13 calculates the printing cycle corresponding to the moving speed by dividing the reference distance L by the moving speed of the printing device 1. That is, the printing cycle corresponds to a time that the printing device 1 moves by the reference distance L. At each time of detecting an elapse of the set printing cycle based on time counting by the timer circuit 111, the print control unit 13 causes the printing mechanism 103 to eject ink to perform printing. Specifically, as shown in FIG. 10B, the print control unit 13 calculates times Ta to Tu at which the printing cycle has elapsed based on time counting by the timer circuit 111, and causes the printing mechanism 103 to eject ink at each timing of the times Ta to Tu to perform printing. For example, at each timing of the times Ta to Tc calculated that the printing cycle that is set at the timing of the time ts has elapsed based on time counting by the timer circuit 111, the print control unit 13 causes the printing mechanism 103 to eject ink to perform printing. Further, at each timing of the times Td and Te calculated that the printing cycle that is set at the timing of time 2ts has elapsed based on time counting by the timer circuit 111, the print control unit 13 causes the printing mechanism 103 to eject ink to perform printing.

As described above, when the moving speed of the printing device 1 is lower than the second speed V2, the control mode setting unit 12 sets the control mode of the printing device 1 to the low-speed mode, and when the moving speed of the printing device 1 is equal to or higher than the first speed V1 and is lower than the maximum speed Vmax, the control mode setting unit 12 sets the control mode of the printing device 1 to the high-speed mode. Therefore, in accordance with control by the print control unit 13, when the moving speed of the printing device 1 is lower than the second speed V2, the printing mechanism 103 prints an image to be printed by ejecting ink onto the printing medium 2 each time the detector 102 detects that the printing device 1 has moved by the reference distance L, and when the moving speed of the printing device 1 is equal to or higher than the first speed V1 and is lower than the maximum speed Vmax, the printing mechanism 103 prints an image to be printed by ejecting ink onto the printing medium 2 for each printing cycle corresponding to the moving speed of the printing device 1. Note that the speed lower than the second speed V2 is an example of a first moving speed according to the present invention, and the speed that is equal to or higher than the first speed V1 and is lower than the maximum speed Vmax is an example of a second moving speed according to the present invention.

Further, as described above, in a state where the control mode of the printing device 1 is set to the low-speed mode, when the moving speed of the printing device 1 is equal to or higher than the first speed V1 and is lower than the maximum speed Vmax, the control mode setting unit 12 changes the control mode of the printing device 1 from the low-speed mode to the high-speed mode. Therefore, in accordance with control by the print control unit 13, in a state of printing an image to be printed by ejecting ink onto the printing medium 2 each time the detector 102 detects that the printing device 1 has moved by the reference distance L, when the moving speed of the printing device 1 is equal to or higher than the first speed V1 and is lower than the maximum speed Vmax, the printing mechanism 103 stops operation of printing of an image to be printed by ejecting ink onto the printing medium 2 each time the detector 102 detects that the printing device 1 has moved by the reference distance L, and the printing mechanism 103 starts operation of printing of an image to be printed by ejecting ink onto the printing medium 2 for each printing cycle corresponding to the moving speed of the printing device 1.

Further, as described above, in a state where the control mode of the printing device 1 is set to the high-speed mode, when the moving speed of the printing device 1 is lower than the second speed V2, the control mode setting unit 12 changes the control mode of the printing device 1 from the high-speed mode to the low-speed mode. Therefore, in accordance with control by the print control unit 13, in a state of printing an image to be printed by ejecting ink onto the printing medium 2 for each printing cycle corresponding to the moving speed of the printing device 1, when the moving speed of the printing device 1 is lower than the second speed V2, the printing mechanism 103 stops operation of printing of an image to be printed by ejecting ink onto the printing medium 2 for each printing cycle corresponding to the moving speed of the printing device 1, and the printing mechanism 103 starts operation of printing of an image to be printed by ejecting ink onto the printing medium 2 each time the detector 102 detects that the printing device 1 has moved by the reference distance L.

In a conventional printing device, in a state of printing an image to be printed by ejecting ink each time the detector detects that the own device has moved by the reference distance L, when the moving amount of the printing device per sampling cycle of the optical sensor provided to the detector exceeds a distance twice the reference distance L, it is not possible to eject twice or more of ink at each reference distance L although it is necessary to eject twice or more of ink at each reference distance L, which may deteriorate print quality. However, in a state where the control mode is set to the high-speed mode, the printing device 1 according to the present embodiment prints an image to be printed by ejecting ink for each printing cycle shorter than the sampling cycle in accordance with the moving speed of the printing device 1, thereby suppressing deterioration in print quality when the moving amount of the printing device 1 per sampling cycle is larger than the reference distance L.

Further, in a conventional printing device, in a state of printing an image to be printed by ejecting ink for each printing cycle corresponding to the moving speed of the printing device, when the printing device stops moving or the moving amount of the printing device per sampling cycle falls below the reference distance L, ejection of ink for each reference distance may fail and print quality may be deteriorated. In the printing device 1 of the present embodiment, in a state where the control mode is set to the low-speed mode, printing of an image to be printed is performed by ejecting ink each time the detector 102 detects that the printing device 1 has moved by the reference distance L, thereby suppressing deterioration in print quality when the printing device 1 stops moving during printing or when a moving amount of the printing device 1 per sampling cycle falls below the reference distance L.

Figure 11A:
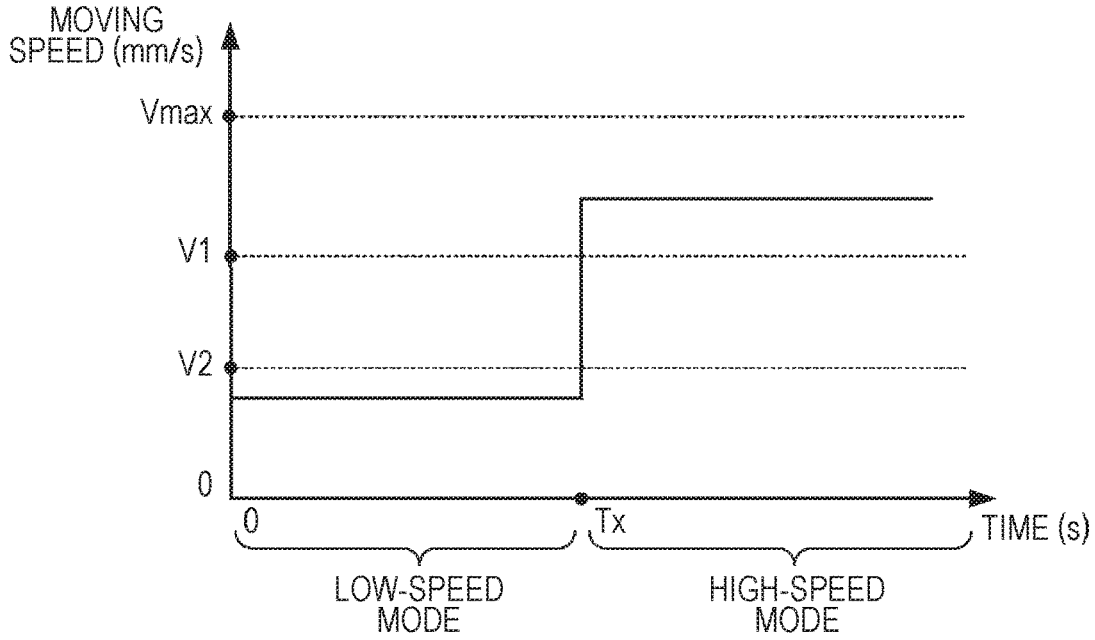

Hereinafter, a description is given to printing by the printing device 1 in cases where the control mode of the printing device 1 is set to the low-speed mode and where the control mode is set to the high-speed mode, with reference to FIGS. 11A and 11B. Specifically, hereinafter, as shown in FIG. 11A, a case will be described, as an example, where the printing device 1 moves at a speed lower than the second speed V2 from a time 0 to a time Tx, and moves at a speed that is higher than the first speed V1 and is lower than the maximum speed Vmax after the time Tx. As shown in FIG. 11A, the control mode of the printing device 1 is set to the low-speed mode from the time 0 to the time Tx, and to the high-speed mode after the time Tx.

Figure 11B:
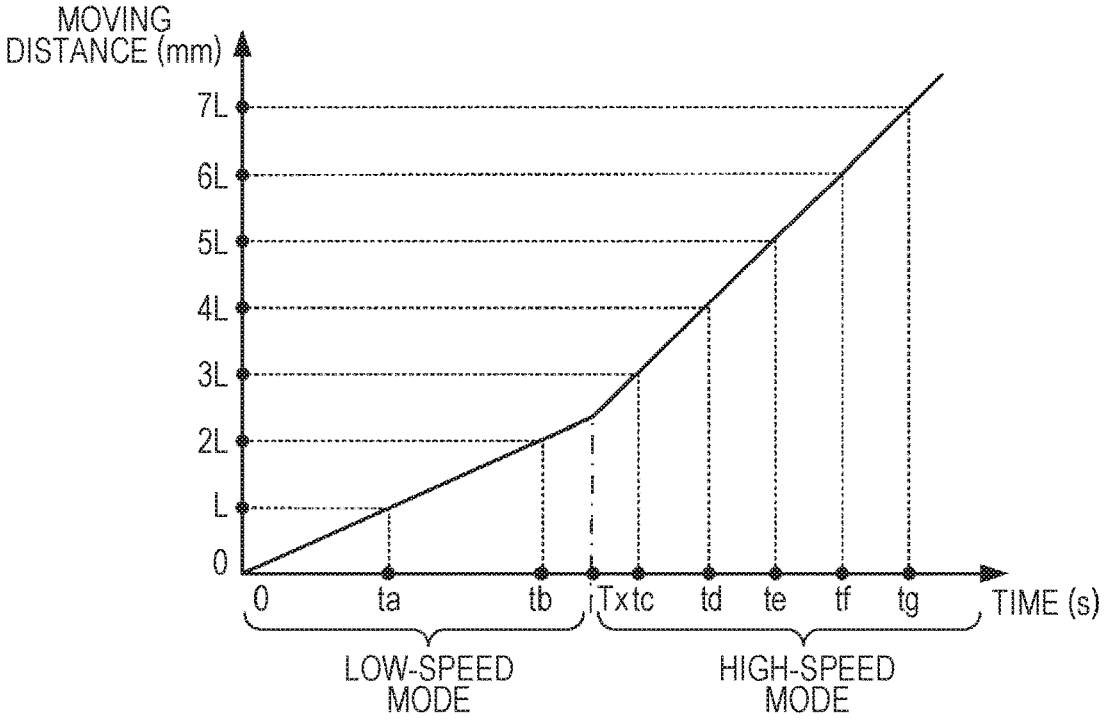
Figure 12:
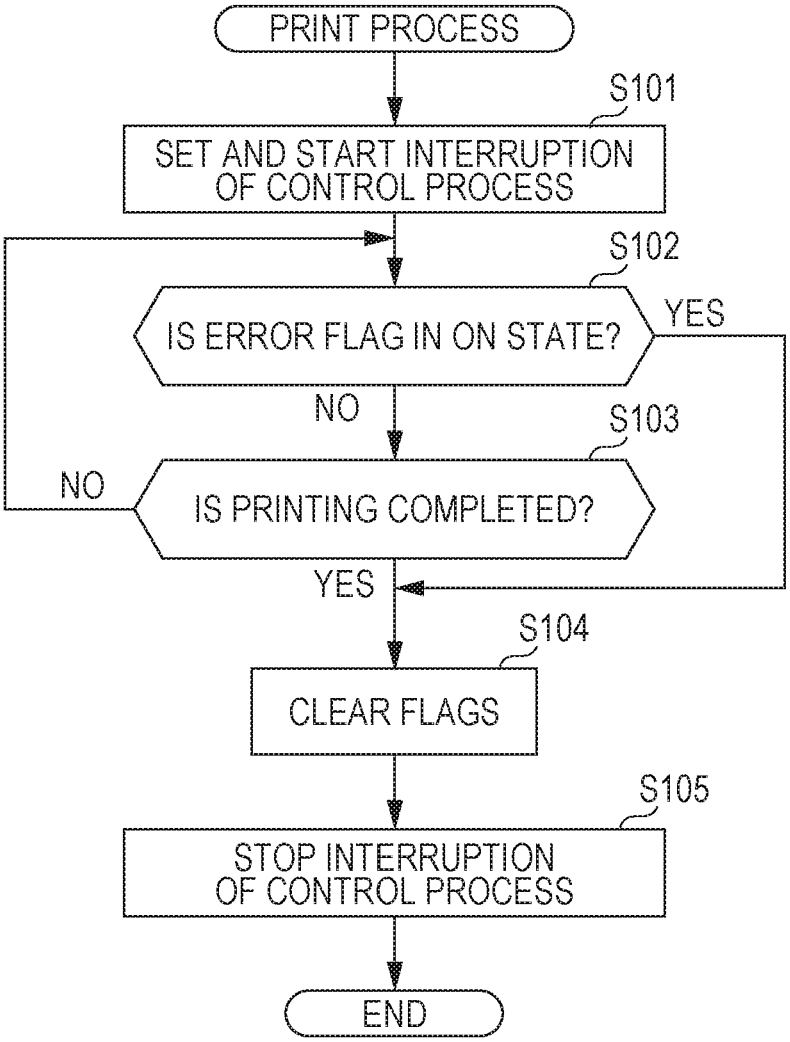
FIG. 12 is a flowchart for explaining a print process executed by a printing device according to an embodiment of the present invention.

As shown in FIG. 11B, in a time section from the time 0 to the time Tx where the control mode is set to the low-speed mode, the printing device 1 ejects ink at timings of times ta and tb, which are timings when the detector 102 detects that the printing device 1 has moved by the reference distance L, to perform printing. As shown in FIG. 11B, the timing of the time ta is a timing at which the moving distance of the printing device 1 reaches the reference distance L, and the timing of the time tb is a timing at which the moving distance of the printing device 1 reaches 2L, which is a distance twice the reference distance L.

As shown in FIG. 11B, in a time section after the time Tx where the control mode is set to the high-speed mode, the printing device 1 ejects ink at timings of times tc to tg, which are timings of detecting an elapse of the printing cycle corresponding to the moving speed of the printing device 1 based on time counting by the timer circuit 111, to perform printing. As shown in FIG. 11B, the times tc to tg are timings at which the moving distance of the printing device 1 reaches 3L to 7L, which are distances 3 to 7 times the reference distance L, respectively.

As shown in FIG. 11B, a time interval between the time ta and the time tb is different from each time interval between the times tc and tg. That is, a time interval of ink ejection in a case where the control mode of the printing device 1 is set to the low-speed mode is set longer than a time interval of ink ejection in a case where the control mode of the printing device 1 is set to the high-speed mode. Whereas, as shown in FIG. 11B, through the cases where the control mode is set to the low-speed mode and where the control mode is set to the high-speed mode, the printing device 1 ejects ink each time the moving distance of the own device increases by the reference distance L, to perform printing. That is, a distance interval of ink ejection in a case where the control mode of the printing device 1 is set to the low-speed mode is equal to a distance interval of ink ejection in a case where the control mode of the printing device 1 is set to the high-speed mode.

As described above, the printing device 1 performs printing by mutually different printing methods for the cases where the control mode is set to the low-speed mode and where the control mode is set to the high-speed mode, and ejects ink at the same distance interval between the cases where the control mode is set to the low-speed mode and where the control mode is set to the high-speed mode, by ejecting ink at mutually different time intervals between the cases where the control mode is set to the low-speed mode and where the control mode is set to the high-speed mode. That is, the printing device 1 performs printing with mutually different printing methods for cases where the control mode is set to the low-speed mode and where the control mode is set to the high-speed mode, thereby suppressing deterioration in print quality.

As described above, when the moving speed of the printing device 1 during approach satisfies the first condition set in advance, the control mode setting unit 12 sets the control mode of the printing device 1 at a start of printing to the low-speed mode. Further, when the moving speed of the printing device 1 during the approach satisfies the second condition set in advance, the control mode setting unit 12 sets the control mode of the printing device 1 at a start of printing to the high-speed mode. Therefore, in accordance with control by the print control unit 13, in a case where the moving speed of the printing device 1 during approach satisfies the first condition, the printing mechanism 103 prints an image to be printed by ejecting ink onto the printing medium 2 each time the detector 102 detects that the printing device 1 has moved by the reference distance L, when the printing is started. Further, in accordance with control by the print control unit 13, in a case where the moving speed of the printing device 1 during approach satisfies the second condition, the printing mechanism 103 prints an image to be printed by ejecting ink onto the printing medium 2 for each printing cycle that is set in accordance with the moving speed of the printing device 1, when the printing is started.

As described above, the printing device 1 sets the control mode of the printing device 1 at a start of printing in accordance with the moving speed of the printing device 1 during approach. Further, as described above, the printing device 1 suppresses deterioration in print quality by performing printing by a printing method corresponding to the control mode. That is, the printing device 1 suppresses the deterioration in print quality by setting the control mode of the printing device 1 at a start of printing in accordance with the moving speed of the printing device 1 during approach.

The print control unit 13 determines whether or not the printing device 1 has been lifted off, by determining whether or not a detection signal supplied from the detection signal acquisition unit 10 satisfies the lift-off condition described above. When determining that the printing device 1 has been lifted off, the print control unit 13 causes the printing mechanism 103 to stop printing. That is, in accordance with control by the print control unit 13, the printing mechanism 103 stops printing in response to the lift off of the printing device 1.

When the moving speed of the printing device 1 calculated by the moving speed calculation unit 11 is equal to or higher than the maximum speed Vmax, the print control unit 13 causes the printing mechanism 103 to stop printing. Further, when the above-described approach speed is equal to or higher than the maximum speed Vmax, the print control unit 13 causes the printing mechanism 103 to stop printing. That is, in accordance with control by the print control unit 13, the printing mechanism 103 stops printing when the moving speed of the printing device 1 is equal to or higher than the maximum speed Vmax. Therefore, the printing device 1 can suppress deterioration in print quality.

Hereinafter, a description is given to a print process executed by the printing device 1 having the above-described physical/functional configuration, with reference to the flowcharts of FIGS. 12 to 18.

The printing device 1 acquires the print data 105*b* generated by an external device such as a PC or a smart phone from the external device via the wireless communication module 110, and stores the data in the ROM 105 in advance. When a user selects the print data 105*b* by operating the input unit 113, the control circuit 104 reads out the print data 105*b* to the RAM 106. In this state, when the user instructs a start of printing by pressing the start button 101, the control circuit 104 starts the print process shown in the flowchart of FIG. 12.

When the print process is started, the control circuit 104 firstly sets interruption of the control process to be described later and starts the control process (step S101). Thereafter, until the interruption of the control process is stopped in processing of step S105 to be described later, the control circuit 104 causes a control process to interrupt at each time of detecting an elapse of the sampling cycle of the optical sensor provided to the detector 102 based on time counting by the timer circuit 111, and repeatedly executes the control process. Details of the control process will be described later with reference to the flowcharts of FIGS. 13 to 18.

Next, the print control unit 13 determines whether or not an error flag is set to an ON state (step S102). As will be described later, the error flag is set to the ON state (step S206, step S309, step S510, step S705) when it is determined that the printing device 1 has been lifted off (step S202; Yes); when it is determined that an approach speed, which is an average value of the moving speed of the printing device 1 during approach, is equal to or higher than the maximum speed Vmax (step S307; No); and when it is determined that the moving speed of the printing device 1 is equal to or higher than the maximum speed Vmax (step S509; No, step S704; No).

When it is determined that the error flag is set to the ON state (step S102; Yes), the print control unit 13 clears the error flag and an approach completion flag to be described later (step S104), stops the interruption of the control process (step S105), and ends the print process. Clearing the error flag and the approach completion flag indicates setting these flags to an OFF state, which is an initial state. Clearing these flags at the end of the print process allows execution of the next print process.

Whereas, when it is determined that the error flag is not set to the ON state (step S102; No), the print control unit 13 determines whether or not printing has been completed, by determining whether or not the print data 105*b* is stored in the RAM 106 (step S103). As will be described later, the print control unit 13 transmits the print data 105*b* to the ink jet head 103*a* for each line to print an image to be printed for each unit (steps S503 and S504, steps S601 and S602), and deletes the transmitted print data 105*b* from the RAM 106 for each line (step S505, step S603). Therefore, by determining whether or not the print data 105*b* is stored in the RAM 106, the print control unit 13 can determine whether or not the printing of the image to be printed represented by the print data 105*b* has been completed.

When the print control unit 13 determines that printing has not been completed (step S103; No), the process returns to step S102. Whereas, when it is determined that the printing is completed (step S103; Yes), the print control unit 13 clears the error flag and the approach completion flag to be described later (step S104), stops the interruption of the control process (step S105), and ends the print process.

Next, details of the control process will be described with reference to the flowcharts of FIGS. 13 to 18.

Figure 13:
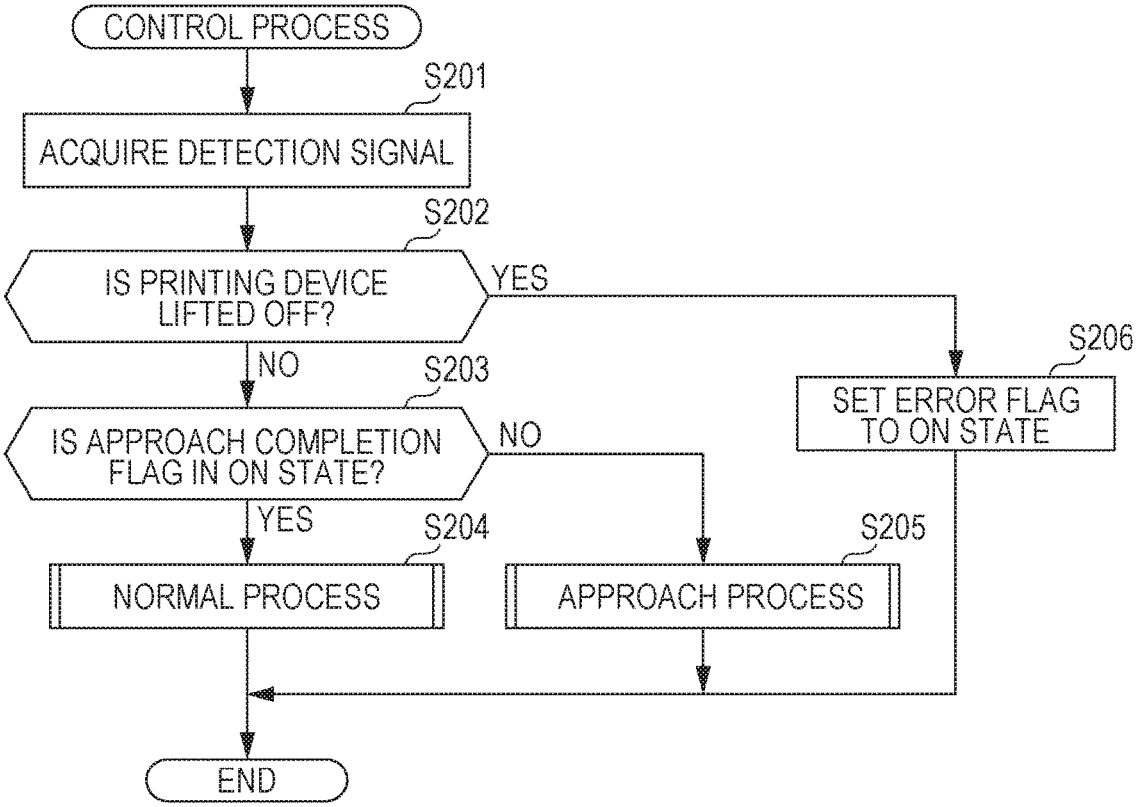
FIG. 13 is a flowchart for explaining a control process executed by a printing device according to an embodiment of the present invention.

When the control process shown in the flowchart of FIG. 13 is started, first, the detection signal acquisition unit 10 acquires a detection signal from the detector 102 (step S201).

The print control unit 13 determines whether or not the printing device 1 has been lifted off, by determining whether or not the detection signal acquired in step S201 satisfies the lift-off condition (step S202). When it is determined that the printing device 1 has been lifted off (step S202; Yes), the print control unit 13 sets the error flag to the ON state (step S206), and ends the control process.

Whereas, when the print control unit 13 determines that the printing device 1 has not been lifted off (step S202; No), the control circuit 104 determines whether or not the approach completion flag is set to ON (step S203). As will be described later, the approach completion flag is set to the ON state (step S304) in response to the determination that the approach has been completed (step S303: Yes).

When it is determined that the approach completion flag is set to the ON state (step S203; Yes), the control circuit 104 executes a normal process to be described later (step S204) and ends the control process. Whereas, when it is determined that the approach completion flag is not set to the ON state (step S203; No), the control circuit 104 executes an approach process to be described later (step S205) and ends the control process.

Hereinafter, details of the approach process will be described with reference to the flowchart of FIG. 14.

Figure 14:
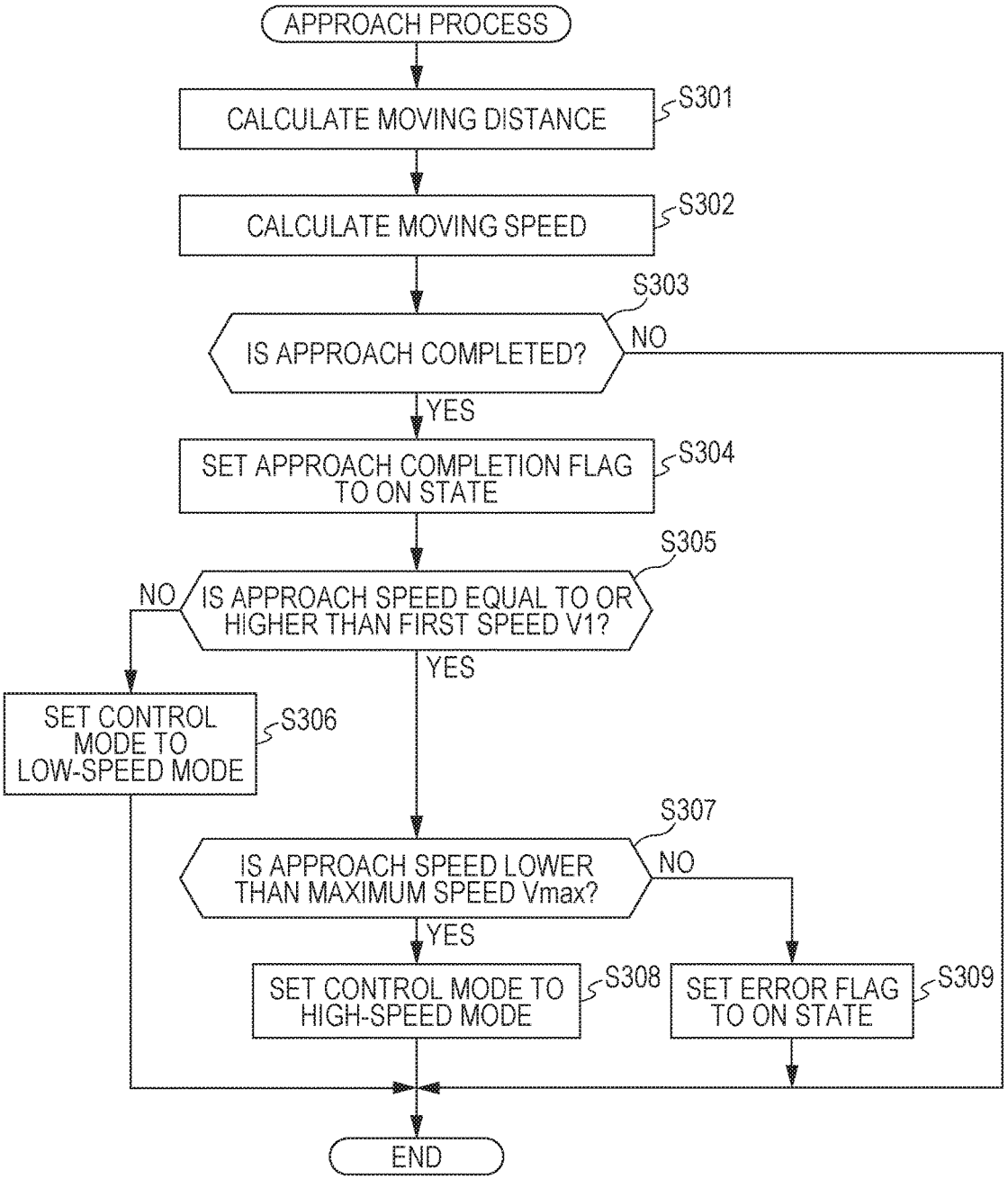
FIG. 14 is a flowchart for explaining an approach process executed by a printing device according to an embodiment of the present invention.

When the approach process shown in the flowchart of FIG. 14 is started, first, in accordance with the moving amount of the printing device 1 indicated by the moving amount detection signal included in the detection signal acquired in step S201 of the flowchart of FIG. 13, the control circuit 104 calculates the moving distance of the printing device 1 from a time point when the start button 101 is pressed (step S301).

Next, the moving speed calculation unit 11 calculates the moving speed of the printing device 1 in accordance with the moving amount of the printing device 1 indicated by the moving amount detection signal included in the detection signal acquired in step S201 (step S302).

The control circuit 104 determines whether or not the approach has been completed, by determining whether or not the moving distance calculated in step S301 is equal to or larger than the approach distance (step S303). When it is determined that the approach has not been completed (step S303; No), the control circuit 104 ends the approach process. Whereas, when it is determined that the approach has been completed (step S303; Yes), the control circuit 104 sets the approach completion flag to the ON state (step S304).

During a period from after the start button 101 is pressed before it is determined that the approach has been completed in step S303 (step S303: Yes), the control mode setting unit 12 determines whether or not the approach speed, which is an average value of the moving speed of the printing device 1 calculated in step S302, is equal to or higher than the first speed V1 (step S305). When it is determined that the approach speed is lower than the first speed V1 (step S305;

No), the control mode setting unit 12 sets the control mode of the printing device 1 at a start of printing to the low-speed mode (step S306), and ends the approach process.

Whereas, when it is determined that the approach speed is equal to or higher than the first speed V1 (step S305; Yes), the control mode setting unit 12 determines whether or not the approach speed is lower than the maximum speed Vmax (step S307). When it is determined that the approach speed is lower than the maximum speed Vmax (step S307; Yes), the control mode setting unit 12 sets the control mode of the printing device 1 at a start of printing to the high-speed mode (step S308), and ends the approach process. Whereas, when it is determined that the approach speed is equal to or higher than the maximum speed Vmax (step S307; No), the control mode setting unit 12 sets the error flag to the ON state (step S309), and ends the approach process.

Next, details of the normal process will be described with reference to the flowcharts of FIGS. 15 to 18.

Figure 15:
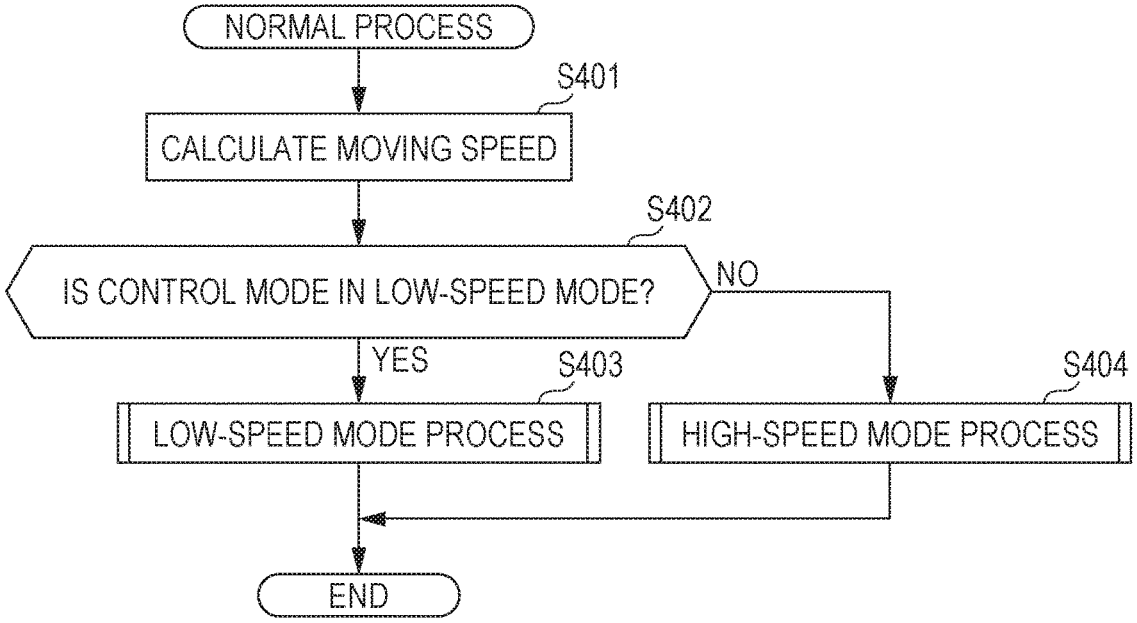
FIG. 15 is a flowchart for explaining a normal process executed by a printing device according to an embodiment of the present invention.

When the normal process shown in the flowchart of FIG. 15 is started, first, in accordance with the moving amount of the printing device 1 indicated by the moving amount detection signal included in the detection signal acquired in step S201 of the flowchart of FIG. 13, the moving speed calculation unit 11 calculates the moving speed of the printing device 1 (step S401).

Next, the control circuit 104 determines whether or not the control mode of the printing device 1 is set to the low-speed mode (step S402). When it is determined that the control mode is set to the low-speed mode (step S402; Yes), the control circuit 104 executes a low-speed mode process to be described later (step S403) and ends the normal process. Whereas, when it is determined that the control mode is not set to the low-speed mode (step S402; No), the control circuit 104 executes a high-speed mode process to be described later (step S404) and ends the normal process.

Hereinafter, details of the low-speed mode process will be described with reference to the flowchart of FIG. 16.

Figure 16:
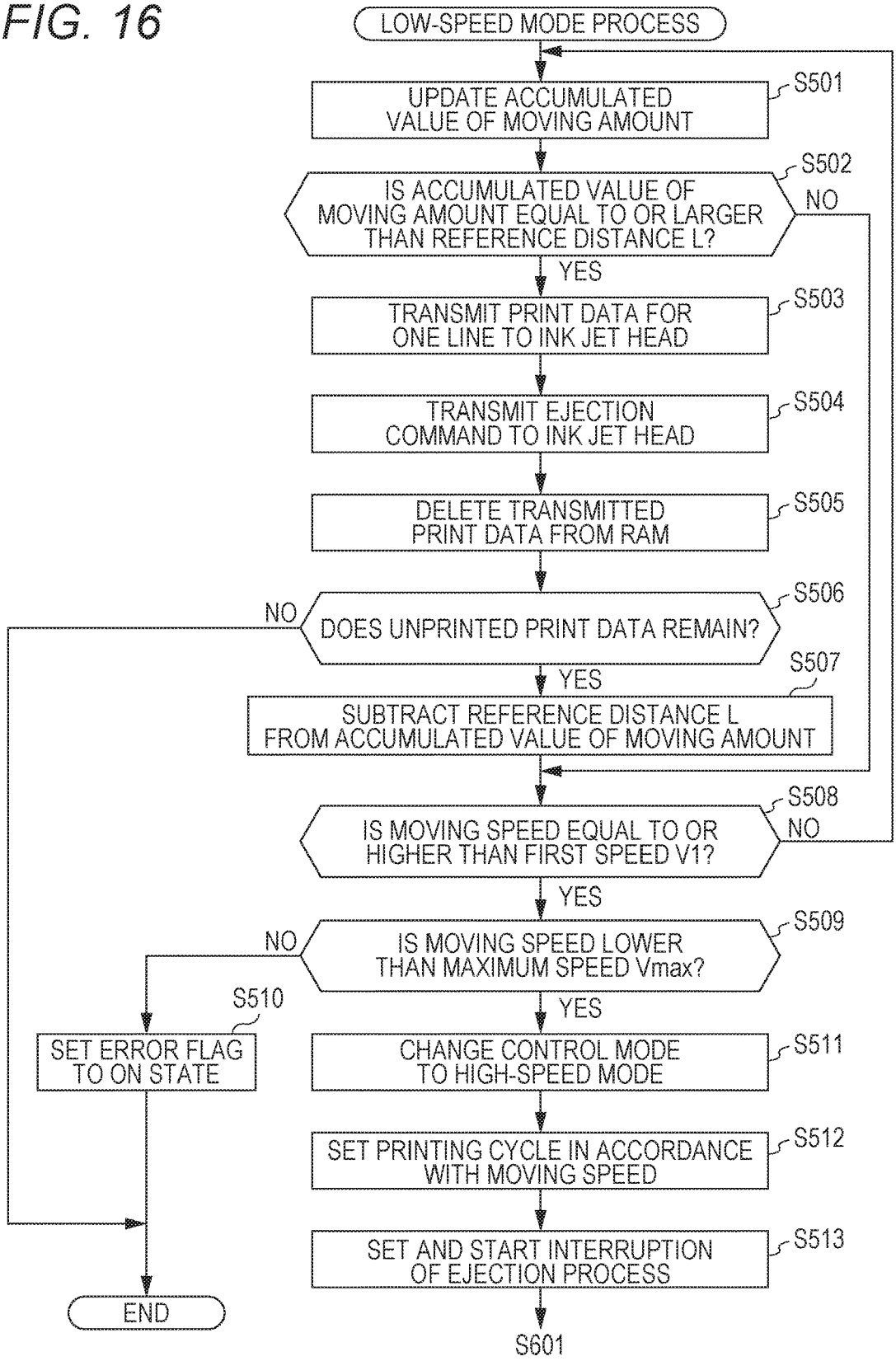
FIG. 16 is a flowchart for explaining a low-speed mode process executed by a printing device according to an embodiment of the present invention.

When the low-speed mode process shown in the flowchart of FIG. 16 is started, first, the print control unit 13 updates an accumulated value of the moving amount of the printing device 1 (step S501) by adding the moving amount per sampling cycle of the printing device 1 indicated by the moving amount detection signal included in the detection signal acquired in step S201 of the flowchart of FIG. 13.

The print control unit 13 determines whether or not the accumulated value of the moving amount of the printing device 1 updated in step S501 is equal to or larger than the reference distance L (step S502). When the print control unit 13 determines that the accumulated value is smaller than the reference distance L (step S502; No), the process proceeds to step S508.

Whereas, when it is determined that the accumulated value of the moving amount of the printing device 1 is equal to or larger than the reference distance L (step S502; Yes), the print control unit 13 causes the ink jet head control circuit 103*b* to transmit, to the ink jet head 103*a*, the print data 105*b* for one line in the print data 105*b* read out to the RAM 106 (step S503). By causing the ink jet head control circuit 103*b* to transmit an ejection command to the ink jet head 103*a* (step S504), the print control unit 13 causes the ink jet head 103*a* to eject ink to perform printing. The print control unit 13 deletes the print data 105*b* for one line (step S505) that has been transmitted in step S503, in the print data 105*b* read out to the RAM 106. Next, when it is determined that unprinted data 105*b* to be printed remains in the RAM 106 after deletion (step S506; Yes), the print control unit 13 subtracts the reference distance L from the accumulated value of the moving amount of the printing device 1 (step S507), and the process proceeds to step S508. When it is determined that unprinted data 105*b* to be printed does not remain in the RAM 106 (step S506; No), the low-speed processing mode is ended.

Next, the control mode setting unit 12 determines whether or not the moving speed of the printing device 1 calculated in step S401 of the flowchart of FIG. 15 is equal to or higher than the first speed V1 (step S508). When it is determined that the moving speed of the printing device 1 is lower than the first speed V1 (step S508; No), the control mode setting unit 12 continues to consider that it is the low-speed mode, and the process returns to step 501.

Whereas, when it is determined that the moving speed of the printing device 1 is equal to or higher than the first speed V1 (step S508; Yes), the control mode setting unit 12 determines whether or not the moving speed of the printing device 1 calculated in step S401 is lower than the maximum speed Vmax (step S509). When it is determined that the moving speed of the printing device 1 is equal to or higher than the maximum speed Vmax (step S509; No), the control mode setting unit 12 sets the error flag to the ON state (step S510), and ends the low-speed mode process.

Whereas, when it is determined that the moving speed of the printing device 1 is lower than the maximum speed Vmax (step S509; Yes), the control mode setting unit 12 changes the control mode of the printing device 1 from the low-speed mode to the high-speed mode (step S511).

The print control unit 13 sets the printing cycle in accordance with the moving speed of the printing device 1 calculated in step S401 (step S512). The print control unit 13 sets interruption of the ejection process to be described later and starts the ejection process (step S513), and the process proceeds to step S601. Thereafter, until the interruption of the control process is stopped in processing of step S105 of the flowchart of FIG. 12, or the interruption of the ejection process is stopped in processing of step S703 to be described later, the print control unit 13 causes the ejection process to interrupt at each time of detecting an elapse of the printing cycle set in step S512 based on time counting by the timer circuit 111, and repeatedly executes the ejection process.

Next, details of the high-speed mode process will be described with reference to the flowchart of FIG. 17.

Figure 17:
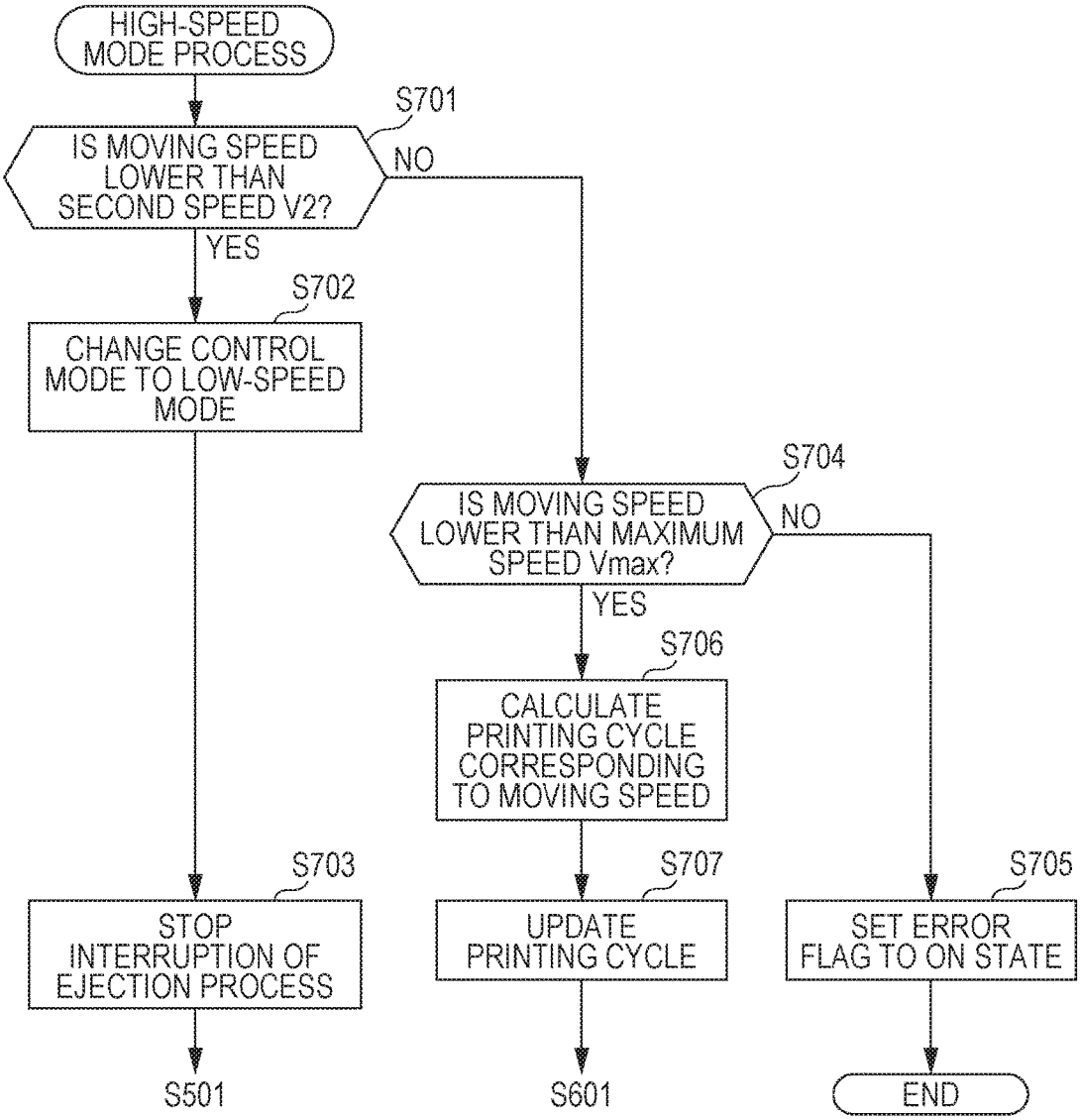
FIG. 17 is a flowchart for explaining a high-speed mode process executed by a printing device according to an embodiment of the present invention.

When the high-speed mode process shown in the flowchart of FIG. 17 is started, the control mode setting unit 12 determines whether or not the moving speed of the printing device 1 calculated in step S401 of the flowchart of FIG. 15 is lower than the second speed V2 (step S701). When it is determined that the moving speed of the printing device 1 is lower than the second speed V2 (step S701: Yes), the control mode setting unit 12 changes the control mode of the printing device 1 from the high-speed mode to the low-speed mode (step S702). The print control unit 13 stops interruption of the ejection process (step S703) and ends the high-speed mode process, and the process proceeds to a process step S501 of the low-speed mode.

Whereas, when it is determined that the moving speed of the printing device 1 is equal to or higher than the second speed V2 (step S701; No), the control mode setting unit 12 determines whether or not the moving speed of the printing device 1 calculated in step S401 is lower than the maximum speed Vmax (step S704). When it is determined that the moving speed of the printing device 1 is equal to or higher than the maximum speed Vmax (step S704; No), the control mode setting unit 12 sets the error flag to the ON state (step S705) and ends the high-speed mode process.

Whereas, when the control mode setting unit 12 determines that the moving speed of the printing device 1 is lower than the maximum speed Vmax (step S704; Yes), the print control unit 13 calculates the printing cycle corresponding to the moving speed of the printing device 1 calculated in step S401 (step S706). The print control unit 13 updates the printing cycle for executing the interruption of the ejection process to the printing cycle calculated in step S706 (step S707), and the process proceeds to step S601 of the ejection process to be described later. That is, in a state where the control mode is set to the high-speed mode, the printing device 1 updates the printing cycle for executing the interruption of the ejection process in accordance with the moving speed of the own device for each sampling cycle of the optical sensor provided to the detector 102 by executing processing of step S707, and the process proceeds to step S601 of the ejection process to be described later.

Figure 18:
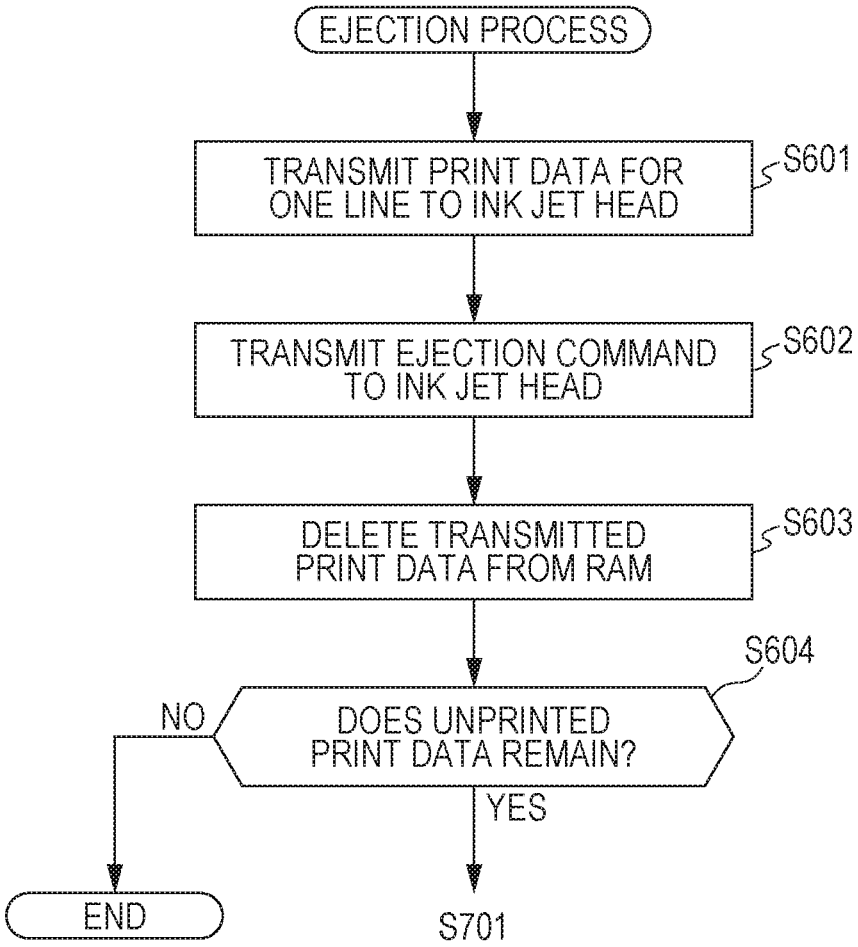
FIG. 18 is a flowchart for explaining an ejection process executed by a printing device according to an embodiment of the present invention.

When the ejection process shown in the flowchart of FIG. 18 is started, the print control unit 13 causes the ink jet head control circuit 103*b* to transmit, to the ink jet head 103*a*, the print data 105*b* for one line in the print data 105*b* read out to the RAM 106 (step S601). By causing the ink jet head control circuit 103*b* to transmit an ejection command to the ink jet head 103*a* (step S602), the print control unit 13 causes the ink jet head 103*a* to eject ink to perform printing. The print control unit 13 deletes the print data 105*b* for one line (step S603) that has been transmitted in step S601, in the print data 105*b* read out to the RAM 106. When it is determined that unprinted data 105*b* to be printed remains in the RAM 106 after the deletion (step S604; Yes), the process proceeds to step S701 of the high-speed mode process, and when it is determined that unprinted data 105*b* to be printed does not remain in the RAM 106 (step S604; No), the ejection process is ended.

As described above, the printing device 1 sets the control mode to the low-speed mode when the moving speed of the printing device 1 is lower than the second speed V2, and the printing device 1 sets the control mode to the high-speed mode when the moving speed of the printing device 1 is equal to or higher than the first speed V1 and is lower than the maximum speed Vmax. When the control mode is set to the low-speed mode, the printing device 1 prints an image to be printed by ejecting ink each time the detector 102 detects that the printing device 1 has moved by the reference distance L. Therefore, the printing device 1 can suppress deterioration in print quality when the printing device 1 stops moving during printing, or when a moving amount of the printing device 1 per sampling cycle of the optical sensor provided to the detector 102 is smaller than the reference distance L. Further, when the control mode is set to the high-speed mode, the printing device 1 prints an image to be printed by ejecting ink for each printing cycle corresponding to the moving speed of the printing device 1. Therefore, the printing device 1 can suppress the deterioration in print quality when the moving amount of the printing device 1 per sampling cycle is larger than the reference distance L. That is, the printing device 1 sets the control mode in accordance with the moving speed of the printing device 1, and performs printing by the printing method according to the control mode, thereby enabling suppression of deterioration in print quality.

Further, the printing device 1 sets the control mode of the printing device 1 at a start of printing in accordance with the moving speed of the printing device 1 during approach. Therefore, the printing device 1 can suppress deterioration in print quality at the start of printing.

Further, when the control mode is set to the high-speed mode, the printing device 1 determines whether or not to switch the control mode in accordance with the relationship between the second speed V2 and the moving speed of the printing device 1. Whereas, when the control mode is set to the low-speed mode, the printing device 1 determines whether or not to switch the control mode in accordance with the relationship between the first speed V1 higher than the second speed V2 and the moving speed of the printing device 1. Therefore, the printing device 1 can suppress a switching frequency of the control mode, reduce a processing load, and reduce a possibility of deterioration in print quality.

Although the embodiment of the present invention has been described above, the above-described embodiment is merely an example, and the application range of the present invention is not limited to this. That is, the embodiment of the present invention can be applied in various ways, and all embodiments fall within the scope of the present invention.

For example, in the above-described embodiment, it is described that the first speed V1 is a speed higher than the second speed V2. However, this is merely an example, and the first speed V1 and the second speed V2 may be the same speed as each other.

Further, in the above-described embodiment, it is described that the print start condition is satisfied when the start button 101 is pressed. However, this is merely an example, and any conditions can be set as the print start condition. For example, the print start condition may be satisfied when the printing device 1 starts moving.

In the above-described embodiment, it is described that the control mode of the printing device 1 at a start of printing is set in accordance with the moving speed of the printing device 1 during approach. However, this is merely an example, and the control mode of the printing device 1 at a start of printing may be set in advance. For example, the low-speed mode may be set in advance as the control mode of the printing device 1 at the start of printing. Alternatively, the high-speed mode may be set in advance as the control mode of the printing device 1 at the start of printing.

In the above-described embodiment, it is described that the first condition is satisfied when the approach speed, which is an average value of the moving speed of the printing device 1 during approach, is lower than the first speed V1, and the second condition is satisfied when the approach speed is equal to or higher than the first speed V1 and is lower than the maximum speed Vmax. However, this is merely an example, and any conditions can be set as the first condition and the second condition. For example, the first condition may be satisfied when the approach speed is lower than the second speed V2, and the second condition may be satisfied when the approach speed is equal to or higher than the second speed V2 and is lower than the maximum speed Vmax. Alternatively, the first condition may be satisfied when a terminal speed, which is a moving speed having the latest time calculated by the moving speed calculation unit 11 among moving speeds of the printing device 1 during approach, is lower than the first speed V1, and the second condition may be satisfied when the terminal speed is equal to or higher than the first speed V1 and is lower than the maximum speed Vmax. Alternatively, the first condition may be satisfied when the terminal speed is lower than the second speed V2 , and the second condition may be satisfied when the terminal speed is equal to or higher than the second speed V2 and is lower than the maximum speed Vmax.

Further, in the above-described embodiment, it is described that the distance DD between the right end RE of the bottom surface 100*b* of the device body 100 and the nozzle row NL is set as the approach distance. However, this is merely an example, and any distance can be set as the approach distance. For example, it is possible to guide a position of the ink jet head 103*a* to a user, provide an auxiliary member to assist setting of the print start position by the user at the right end RE of the bottom surface 100*b*, and set the distance between the auxiliary member and the nozzle row NL as the approach distance. Further, in the above-described embodiment, it is described that the printing mechanism 103 performs printing by the inkjet method. However, this is merely an example, and the printing mechanism 103 may perform printing by any method. For example, the printing mechanism 103 may perform printing by a thermal method or a thermal transfer method.

In the above-described embodiment, it is described that the printing device 1 acquires the print data 105*b* generated by an external device, from the external device via the wireless communication module 110. However, this is merely an example, and the printing device 1 can acquire the print data 105*b* by any method. For example, the printing device 1 may include a wired communication interface such as a universal serial bus (USB) port, and may transmit and receive data with an external storage medium using the wired communication interface thereby to acquire the print data 105*b* stored in the storage medium. Alternatively, the printing device 1 may accept an input of print contents using the input unit 113 by the user without externally receiving the print data, and may generate the print data 105*b* in accordance with the input print contents.

Further, in the above-described embodiment, it is described that the printing device 1 is a manual-scanning printing device. However, this is merely an example, and the printing device 1 may be a self-propelled printing device having a moving unit configured to move the own device on the printing medium 2 to perform printing in accordance with the movement.

Further, in the above-described embodiment, it is described that the detector 102 includes the optical sensor, and the optical sensor detects the moving direction and the moving amount of the printing device 1. However, this is merely an example, and the detector 102 can detect the moving direction and the moving amount of the printing device 1 by any method. For example, the detector 102 may detect the moving direction and the moving amount of the printing device 1 by a mechanical encoder. Specifically, the mechanical encoder includes a rotary member that comes into contact with the printing medium 2 in a state where the printing device 1 is placed on the printing medium 2, and rotates in accordance with the movement of the printing device 1 on the printing medium 2, and the mechanical encoder may detect the moving direction and the moving amount of the printing device 1 in accordance with the rotation of the rotating member.

Further, in the above-described embodiment, it is described that the detector 102 has the laser optical sensor, but this is merely an example, and the detector 102 may have any type of optical sensor. For example, the detector 102 may include an LED optical sensor configured to irradiate light from an LED light source to a surface of the printing medium 2, and output a moving amount detection signal indicating a moving direction and a moving amount of the printing device 1 by capturing and analyzing a shadow caused by unevenness on the surface of the printing medium 2.

It is to be noted that, in addition to providing as a printing device provided with the configuration for realizing the functions according to the present invention in advance, it is possible to cause an existing information processing apparatus or the like to function as a printing device according to the present invention, by applying a program. That is, by applying the program for implementing each functional configuration of the printing device according to the present invention so as to enable execution of the program by a CPU or the like configured to control an existing information processing apparatus or the like, the existing information processing apparatus or the like can function as the printing device according to the present invention.

Meanwhile, such a program can be applied by any method. For example, the program can be applied by storing in a computer-readable storage medium such as a flexible disk, a compact disc (CD)-ROM, a digital versatile disc (DVD)-ROM, or a memory card. Furthermore, the program may be superimposed on a carrier wave and applied via a communication medium such as the Internet. For example, the program may be posted and distributed on a bulletin board system (BBS) on a communication network. Then, the above processing may be executed by starting and executing this program in the same manner as other application programs under control of an operating system (OS).

Although the desirable embodiments of the present invention have been described above, the present invention is not limited to specific embodiments, and the invention described in the claims and its equivalent scope are included in the present invention.

What is claimed is:

1. A printing device comprising:

a printing head configured to print an image on a printing medium while moving relative to the printing medium;

a detector configured to detect a moving amount of the printing head for each sampling cycle, the moving amount being relative to the printing medium; and a processor configured to perform a first control to cause the printing head to perform printing when a moving speed of the printing head based on the moving amount detected by the detector and the sampling cycle is equal to or higher than a first moving speed at which the moving amount for each the sampling cycle becomes a reference distance corresponding to a print resolution of the printing head, the printing being performed at a timing that has been set in accordance with the moving speed.

2. The printing device according to claim 1, wherein the processor performs a second control to cause the printing head to perform printing at a timing based on an accumulated value of the moving amount for each the sampling cycle when the moving speed is lower than the first moving speed.

3. The printing device according to claim 2, wherein the processor calculates, in the first control, a first timing each time the printing head moves the reference distance based on the moving speed, and causes the printing head to perform printing at each calculated first timing; and calculates, in the second control, a second timing each time the printing head moves the reference distance based on an accumulated value of the moving amount, and causes the printing head to perform printing at each calculated second timing.

4. The printing device according to claim 2, wherein the processor causes the printing head to start printing after an instruction to start printing by the printing head is issued and then the printing head has moved an approach distance; and selects whether to perform the first control or the second control at a start of printing by the printing head, in accordance with the moving speed of the printing head while the printing head moves the approach distance.

5. The printing device according to claim 2, wherein the processor changes the first control to the second control when the moving speed becomes equal to or higher than a first speed during printing by the printing head with the first control; and changes the second control to the first control when the moving speed becomes lower than a second speed during printing by the printing head with the second control.

6. The printing device according to claim 5, wherein the first speed is higher than the second speed.

7. The printing device according to claim 1, wherein the printing head performs printing by ejecting ink by an inkjet method.

8. A printing method executed by a printing device, wherein when a moving speed of a printing head based on a relative moving amount of the printing head of the printing device with respect to a printing medium for each sampling cycle and the sampling cycle is equal to or higher than a first moving speed at which the relative moving amount for each the sampling cycle becomes a reference distance corresponding to a print resolution of the printing head, printing is performed by the printing head at a timing that is set in accordance with the moving speed.

9. A non-transitory storage medium readable by a computer configured to control a printing device, the storage medium storing a computer program, wherein, when the computer program is executed, in a case in which a moving speed of a printing head based on a relative moving amount of the printing head of the printing device with respect to a printing medium for each sampling cycle and the sampling cycle is equal to or higher than a first moving speed at which the relative moving amount for each the sampling cycle becomes a reference distance corresponding to a print resolution of the printing head, printing is performed by the printing head at a timing that is set in accordance with the moving speed.

* * * * *